US012089664B2

(12) United States Patent
Pare et al.

(10) Patent No.: US 12,089,664 B2
(45) Date of Patent: Sep. 17, 2024

(54) PERSONAL THERMOREGULATION BACKPACK AND SYSTEM USING EMBEDDED FLEXIBLE TUBING

(71) Applicant: Oceanit Laboratories, Inc., Honolulu, HI (US)

(72) Inventors: Ravi Pare, Kailua, HI (US); Jimmie Harris, Honolulu, HI (US); Venkat Kamavaram, Honolulu, HI (US)

(73) Assignee: Oceanit Laboratories, Inc., Honolulu, HI (US)

( * ) Notice: Subject to any disclaimer, the term of this patent is extended or adjusted under 35 U.S.C. 154(b) by 261 days.

(21) Appl. No.: 17/880,575

(22) Filed: Aug. 3, 2022

(65) Prior Publication Data

US 2023/0051351 A1 Feb. 16, 2023

Related U.S. Application Data

(60) Provisional application No. 63/229,485, filed on Aug. 4, 2021.

(51) Int. Cl.

| | |
|---|---|
| ***A41D 13/005*** | (2006.01) |
| ***A45F 3/04*** | (2006.01) |
| ***A45F 4/02*** | (2006.01) |

(52) U.S. Cl.

CPC ..... *A41D 13/0053* (2013.01); *A45F 3/04* (2013.01); *A45F 4/02* (2013.01)

(58) Field of Classification Search

CPC ..... A41D 13/0053; A45F 3/04; A45F 4/02; A45F 2003/166

See application file for complete search history.

(56) References Cited

U.S. PATENT DOCUMENTS

| | | | | |
|---|---|---|---|---|
| 2004/0079517 | A1* | 4/2004 | Bueley | A41D 13/0053 165/138 |
| 2006/0191049 | A1* | 8/2006 | Elkins | A62B 17/005 224/148.4 |
| 2006/0201187 | A1* | 9/2006 | Smolko | A41D 13/0053 62/315 |
| 2010/0101253 | A1* | 4/2010 | Searle | A41D 13/0025 62/259.3 |
| 2010/0223943 | A1* | 9/2010 | Loukaides | A41D 13/0053 62/259.3 |
| 2013/0319031 | A1* | 12/2013 | Coats, IV | A41D 13/0025 165/46 |

(Continued)

*Primary Examiner* — Emmanuel E Duke

(74) *Attorney, Agent, or Firm* — Fresh IP PLC; Clifford D. Hyra; Aubrey Y. Chen

(57) ABSTRACT

Disclosed herein are thermally conductive materials, including, for instance, thermally conductive tubing, thermally conductive devices and/or systems (e.g., apparel, backpacks, and the like), and applications thereof. In at least one embodiment, a thermally conductive material is disclosed that is made from one or more base polymers and one or more additives that increase the thermal conductivity of the thermally conductive material relative to the one or more base polymers. In additional embodiments, a cooling vest and a cooling backpack are disclosed, both of which are wearable by human users to keep their body temperature below a certain value. The vest and/or the backpack may include tubing through which coolant flows. The tubing is placed within the fabric and is arranged so that it contacts the user's skin.

21 Claims, 17 Drawing Sheets

(56) References Cited

U.S. PATENT DOCUMENTS

| | | | | |
|---|---|---|---|---|
| 2015/0374045 | A1* | 12/2015 | Codner | A61F 7/02 2/455 |
| 2016/0206018 | A1* | 7/2016 | Barbret | A41D 13/0053 |
| 2018/0153230 | A1* | 6/2018 | Verner | A41D 27/20 |
| 2019/0367172 | A1* | 12/2019 | Carver | A61F 7/02 |
| 2020/0281284 | A1* | 9/2020 | McAllister | A41D 13/0053 |
| 2021/0137181 | A1* | 5/2021 | Patel | A41D 31/145 |

* cited by examiner

| | | Material | Tube length | Volume | Cooling Capacity | Rate of cooling | Duration of cooling |
|---|---|---|---|---|---|---|---|
| 1002 | Unit 1 | M1 | L1 | V1 | W1 | R1 | W1/R1 |
| 1004 | Unit 2 | M2 | L2 | V2 | W2 | R2 | W2/R2 |
| 1006 | Unit 3 | M3 | L3 | V3 | W3 | R3 | W3/R3 |

PERSONAL THERMOREGULATION BACKPACK AND SYSTEM USING EMBEDDED FLEXIBLE TUBING

CROSS-REFERENCE TO RELATED APPLICATIONS

This application claims priority to U.S. Provisional Application No. 63/229,485, filed Aug. 4, 2021, which is hereby incorporated by reference in its entirety.

STATEMENT REGARDING FEDERALLY SPONSORED RESEARCH OR DEVELOPMENT

The invention described herein was made with U.S. government ("Government") support under Contract No. 201931, awarded by the U.S. Department of Defense. As a result, the Government has certain rights in this invention.

FIELD

The disclosure relates generally to devices, systems, and methods for cooling and/or thermoregulation, including, for instance, thermoregulatory apparel, thermally conductive tubing, and applications thereof. In particular, the disclosure relates to a wearable, thermoregulatory backpack.

BACKGROUND

Wearable apparel and devices that can help thermoregulate the user by, for example, providing heating and/or cooling is desirable, and even necessary, for a wide range of functions and use scenarios. For instance, hikers, bikers, campers, and other individuals engaging in outdoor activities may want or need thermoregulatory apparel to be more comfortable, thereby enabling them to continue their activities for a longer period and increased performance due to a lower core body temperature. Thermoregulatory devices and/or systems can also be used in other applications to keep users comfortable while they perform physically and/or mentally demanding tasks, e.g., medicine, construction and other industries, such as firefighters, soldiers, etc.

Non-limiting examples of wearable thermoregulatory devices include, for example, cooling vests, cooling and/or heating pads, and the like. These can contain various thermally conductive materials, such as, for instance, metals and composite materials (e.g., polymer composites and thermally conductive elastomers, including, for instance, elastomers sold at the celanese.com website.

Currently-available thermoregulatory devices and systems, however, are often only suitable for a narrow range of potential uses. For instance, wearable thermoregulatory devices (such as, for instance, thermoregulatory apparel) often fails to heat and/or cool efficiently, and is further bulky or heavy to wear. Indeed, metal materials that are often present in thermoregulatory devices are often stiff and hard, making them unsuitable for many heat transfer or thermoregulatory applications that require mechanical flexibility. Polymers are also mostly thermally non-conductive, except for conjugate polymers, which are often expensive, cost prohibitive, and/or not readily manufacturable with suitable properties in wearable devices (e.g., thermoregulatory apparel).

Various challenges exist with currently-available wearable thermoregulatory devices and/or systems. For instance, portable cooling vests must include portable systems, including, for example, vapor compression systems, to circulate coolant through the vest. These systems must be carried by the user, which makes them expensive to produce and maintain, as well as impractical for long periods of use and/or for physically demanding tasks. As a non-limiting example, a typical commercially-available cooling system with a wearable component can be found at the coolshirt.com website, and contains a wearable item of apparel (in this case, a shirt) that has tubing through which coolant flows. However, the coolant is provided in a separate coolant reservoir that is not worn by the user. Such cooling systems have reduced portability, and are therefore inconvenient and difficult to use, especially in outdoor environments. Additionally, personal cooling systems that are worn by the user often lack sufficient flexibility or stretch in order to adequately accommodate a user's movements, thereby limiting their effectiveness and potential use applications. For example, wearable devices or apparel that are too rigid and/or constricting do not permit the user to perform tasks that require a wide range of body movements and/or agility. Moreover, many wearable cooling mechanisms, e.g., apparel with integrated ice packs or cooling packs, do not use liquid cooling.

Given the foregoing, there exists a significant need for devices, systems, and materials that can provide adequate thermoregulation and, in particular, a need for wearable devices and/or systems that are easy to use, thermally conductive, and sufficiently light and flexible to be used in a variety of applications.

SUMMARY

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description.

In certain embodiments, the disclosed embodiments may include one or more of the features described herein.

Embodiments of the present disclosure are directed towards thermoregulatory devices and/or systems that are wearable by a user and that provide heating and/or cooling to the user. Such wearable devices or systems include, for instance, apparel (e.g., a cooling vest), a thermoregulatory backpack, and the like. Additional embodiments relate to thermally conductive materials (e.g., polymers) for use in thermally conductive tubing, which can be integrated into the wearable thermoregulatory devices or systems. As non-limiting examples, such thermally conductive tubing can be used in a cooling vest and a cooling backpack, both of which are wearable by the user and both of which conduct heat away from the user's body.

In the context of this application, tubing that is "in contact" with a user or wearer's skin/body is arranged such that heat may be exchanged between the tubing and the skin by conduction. The tubing may or may not be in direct contact with the skin and, in some embodiments, may have one or more layers of material between the tubing and the skin.

In at least one embodiment, a thermally conductive material comprises one or more base polymers and one or more additives that increase thermal conductivity relative to the one or more base polymers. Such additives can include, for example, metal or ceramic additives. Non-limiting examples of such additives include, for instance, graphite fibers. Accordingly, in at least one embodiment, the thermally conductive material comprises a base polymer comprising either ethylene vinyl acetate (EVA) or ethylene methyl acetate (EMA), and at least 8% by weight graphite fibers. The concentration of graphite fibers may be 8% to 40% by weight, and, in particularly preferred embodiments, 8%, 12%, or 20%. In specific embodiments, the base polymer is EVA and the graphite fibers have a concentration by weight of either 8% or 12%. The material of such embodiments has a hardness of 60 to 70 Shore A, a tensile stress of 1570 to 1660 psi, an elongation (cm) of 200% to 230%, a break stress of 1410 to 1530 psi, and a thermal conductivity of 0.3 W/mK to 0.4 W/mK.

One or more embodiments further comprise a thermally conductive material having a secondary polymer and/or a plasticizer, either or both of which serve to reduce hardness of the thermally conductive material and/or to increase thermal conductivity of the thermally conductive material relative to thermal conductivity of the one or more base polymers. The secondary polymer may have a lower hardness than the one or more base polymers and may include, for instance, ethylene propylene diene monomer (EPDM), and the plasticizer may include, for example, bis(2-ethylhexyl) adipate (DEHA). Accordingly, in at least one embodiment, the thermally conductive material comprises a base polymer that is 70% by weight EMA, 15% by weight graphite fibers, and 15% by weight DEHA. Such a material may have a hardness of 60 to 62 Shore A and a thermal conductivity of approximately 0.3 W/mK. In a further embodiment, the thermally conductive material comprises a base polymer that is 65% by weight EVA, 15% by weight graphite fibers, 15% by weight DEHA, and 5% by weight EPDM. In still further embodiments, the thermally conductive material comprises a base polymer that is 70% by weight EVA, 15% by weight graphite fibers, and 15% by weight DEHA. Such a material may have a hardness of approximately 75 Shore A and a thermal conductivity of approximately 0.3 W/mK.

In additional embodiments, the thermally conductive material comprises one or more base polymers, one or more additives, a secondary polymer, and a plasticizer, wherein the one or more base polymers comprises 65% to 70% by weight of EVA or EMA, wherein the one or more additives comprises 12% to 15% by weight of graphite fibers, wherein the secondary polymer comprises 0% to 5% by weight of EPDM, and wherein the plasticizer comprises 15% to 20% by weight of DEHA.

Further embodiments comprise a thermally conductive tube and/or a thermally conductive sheet comprising one or more of the thermally conductive materials recited above. In additional embodiments, a method of manufacturing such thermally conductive tubes and/or thermally conductive sheets comprises extruding one or more of the thermally conductive materials recited above into a thermally conductive tube and/or a thermally conductive sheet.

It should be appreciated that one or more of the base polymers may comprise at least one polymer resin matrix, and that the base polymer may be selected from the group consisting of: EVA, EMA, Room-Temperature-Vulcanizing (RTV) silicone, and combinations thereof.

Additionally, in some embodiments, the one or more additives is selected from the group consisting of: graphite fibers, boron nitride, zinc oxide (ZnO), multi-walled carbon nanotubes (MWCNT), graphene, and combinations thereof.

A method for producing a thermally conductive material is also disclosed herein. The method may comprise combining one or more base polymers with one or more additives, thereby producing a composite material, wherein the one or more additives increases thermal conductivity of the composite material relative to the one or more base polymers, and adding a secondary polymer and/or a plasticizer to the composite material, thereby producing the thermally conductive material. In some embodiments, the combining step may be performed using a twin screw-extruder compounding machine. In further embodiments, the aforementioned method may further comprise producing a plurality of thermally conductive tubes from the thermally conductive material, and/or producing a plurality of thermally conductive sheets from the thermally conductive material. It should be appreciated that the thermally conductive material produced by the method may be one or more of the thermally conductive materials mentioned above herein.

A method for using a thermally conductive material is also disclosed herein. The method comprises utilizing thermally conductive material in a wearable thermoregulatory system. The thermally conductive material may be one or more of the thermally conductive materials recited above, and the wearable thermoregulatory system may be, for instance, a piece of wearable apparel such as, e.g., a cooling vest, or a wearable item such as, e.g., a cooling backpack.

In additional embodiments, wearable devices and/or systems that thermoregulate the user are disclosed, such as, for instance, a cooling vest or a cooling backpack. The cooling vest and the cooling backpack may each comprise tubing incorporated into the fabric. Such tubing provides the ability to cool the user while stretching to accommodate the user's movements.

In at least a further embodiment, the cooling backpack comprises a central portion, shoulder straps connected to the central portion, a bottom portion connected to the central portion, tubing that runs through the central portion, the plurality of shoulder straps, and the bottom portion. The cooling backpack further comprises one or more coolant reservoirs (e.g., a bladder) containing coolant, and the tubing is fluidly connected with the reservoir. As a result, the coolant circulates from the reservoir throughout the tubing. Such circulation may be accomplished via one or more devices (e.g., a pump and battery combination, where the battery provides power to operate the pump, and the pump is operable to circulate the coolant from the reservoir throughout the tubing). In some embodiments, the coolant reservoir and/or the one or more circulation devices (e.g., the pump and the battery) are disposed within a pocket on the backpack. The coolant may comprise one or more of water, ice, cooling gel, and the like. In some embodiments, the coolant may also be potable. The cooling backpack may further comprise a sleeve, which may be, for instance, disposed on the central portion, for receiving a cylindrical object (e.g., water bottle, thermos, container, etc.). Accordingly, a hydration tube can extend from the cylindrical sleeve through one or more flaps disposed on the backpack, thereby enabling a user to use the hydration tube to intake fluid from a container stored in the cylindrical sleeve. In additional embodiments, the coolant reservoir is detachable from the wearable article of manufacture and refillable with additional and/or new coolant.

One of skill in the art will recognize that existing wearable thermoregulatory devices and/or systems, including thermoregulatory apparel (e.g., cooling apparel), is of limited use due to inflexibility, rigidity, and/or inability to provide adequate heating and/or cooling. Flexibility, in particular, is extremely important to allow for different users' needs. However, existing apparel does not optimize different factors such as the amount of cooling, the duration of cooling, the weight of the cooling system, and the flexibility of the apparel. Embodiments disclosed herein therefore enables a balance between effective thermoregulation in a wearable form factor, while maintaining suitable flexibility that accommodates a range of movements and use scenarios.

These and further and other objects and features of the invention are apparent in the disclosure, which includes the above and ongoing written specification, as well as the drawings.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art. The invention will be more particularly described in conjunction with the following drawings wherein.

DETAILED DESCRIPTION

Figure 1:
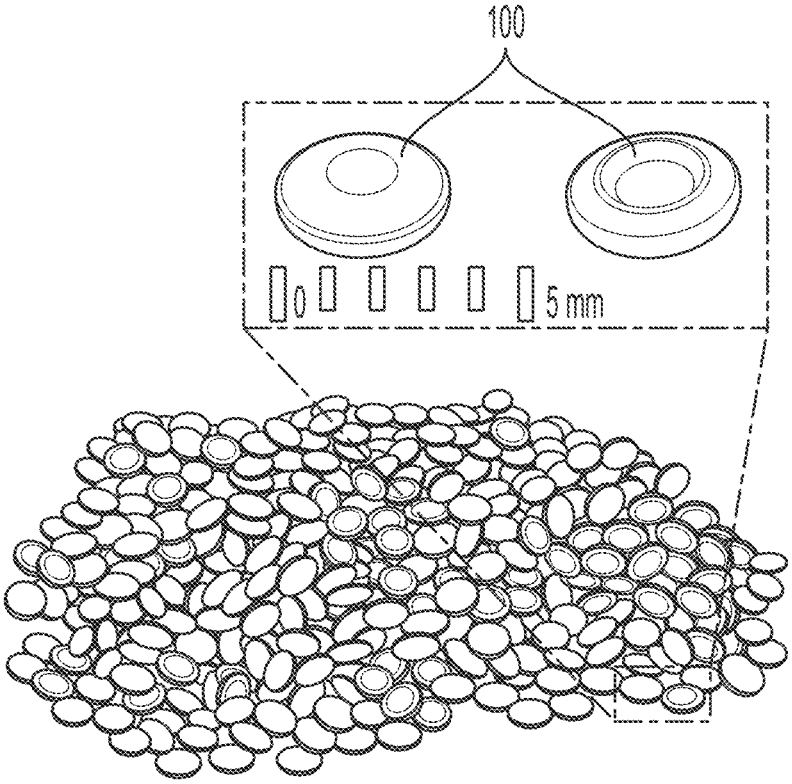
FIG. 1 is a depiction of an exemplary thermally conductive material in pellet form, according to at least one embodiment of the present disclosure.

The present invention is more fully described below with reference to the accompanying figures.

The following description is exemplary in that several embodiments are described (e.g., by use of the terms "preferably," "for example," or "in one embodiment"), however, such should not be viewed as limiting or as setting forth the only embodiments of the present invention, as the invention encompasses other embodiments not specifically recited in this description, including alternatives, modifications, and equivalents within the spirit and scope of the invention. Further, the use of the terms "invention," "present invention," "embodiment," and similar terms throughout the description are used broadly and not intended to mean that the invention requires, or is limited to, any particular aspect being described or that such description is the only manner in which the invention may be made or used. Additionally, the invention may be described in the context of specific applications; however, the invention may be used in a variety of applications not specifically described.

The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. When a particular feature, structure, or characteristic is described in connection with an embodiment, persons skilled in the art may effect such feature, structure, or characteristic in connection with other embodiments whether or not explicitly described.

In the several figures, like reference numerals may be used for like elements having like functions even in different drawings. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail. Any signal arrows in the drawings/figures should be considered only as exemplary, and not limiting, unless otherwise specifically noted. Further, the description is not to be taken in a limiting sense, but is made merely for the purpose of illustrating the general principles of the invention, since the scope of the invention is best defined by the appended claims.

It will be understood that, although the terms first, second, etc. may be used herein to describe various elements, these elements should not be limited by these terms. These terms are only used to distinguish one element from another. Purely as a non-limiting example, a first element could be termed a second element, and, similarly, a second element could be termed a first element, without departing from the scope of example embodiments. As used herein, the term "and/or" includes any and all combinations of one or more of the associated listed items. As used herein, the singular forms "a", "an," and "the" are intended to include the plural forms as well, unless the context clearly indicates otherwise.

It should also be noted that, in some alternative implementations, the functions and/or acts noted may occur out of the order as represented in at least one of the several figures. Purely as a non-limiting example, two figures shown in succession may in fact be executed substantially concurrently or may sometimes be executed in the reverse order, depending upon the functionality and/or acts described or depicted.

Ranges are used herein shorthand so as to avoid having to list and describe each and every value within the range. Any appropriate value within the range can be selected, where appropriate, as the upper value, lower value, or the terminus of the range.

Unless indicated to the contrary, numerical parameters set forth herein are approximations that can vary depending upon the desired properties sought to be obtained. At the very least, and not as an attempt to limit the application of the doctrine of equivalents to the scope of any claims, each numerical parameter should be construed in light of the number of significant digits and ordinary rounding approaches.

The words "comprise", "comprises", and "comprising" are to be interpreted inclusively rather than exclusively. Likewise the terms "include", "including" and "or" should all be construed to be inclusive, unless such a construction is clearly prohibited from the context. The terms "comprising" or "including" are intended to include embodiments encompassed by the terms "consisting essentially of" and "consisting of". Similarly, the term "consisting essentially of" is intended to include embodiments encompassed by the term "consisting of". Although having distinct meanings, the terms "comprising", "having", "containing" and "consisting of" may be replaced with one another throughout the present disclosure.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

"Typically" or "optionally" means that the subsequently described event or circumstance may or may not occur, and that the description includes instances where said event or circumstance occurs and instances where it does not.

Wherever the phrase "for example," "such as," "including," and the like are used herein, the phrase "and without limitation" is understood to follow unless explicitly stated otherwise.

Generally, embodiments of the present disclosure are directed towards thermally conductive materials, including, as non-limiting examples, thermally conductive tubing, thermally conductive apparel, and thermally conductive devices and/or systems (e.g., a cooling backpack). Further embodiments relate to thermally conductive tubing that can be utilized in a wearable form factor (e.g., a cooling vest or a cooling backpack) designed to manage the user's body heat. Such tubing can also be used in a variety of applications, including, for example, heat extraction systems, thermal management applications, and heat sinks.

Accordingly, at least one embodiment comprises thermally conductive material formed from a combination of a base polymer and at least one additive that increases the thermal conductivity of the base polymer. The at least one additive may comprise, as non-limiting examples, metallic or ceramic additives. In addition to thermal conductivity, other properties of the at least one additive may be important, including physical properties such as, for instance, mechanical strength, flexibility, and hardness. Hardness of the thermally conductive material should preferably be between 60-70 Shore A, while the material's mechanical strength/stress should preferably be between 1500-1700 psi, and the material's elongation at break should preferably be between 200-260%. It should be appreciated that these physical properties of the thermally conductive material depend, at least in part, upon the specific additive and the specific base polymer chosen to be combined with each other, as well as the amount and composition of both the additive and the polymer.

Table 1 below shows a list of exemplary base polymers that can be used to manufacture thermally conductive materials.

TABLE 1

Exemplary polymers for use in manufacturing thermally conductive materials.

| Material | Type |
|---|---|
| EVA - Ethylene Vinyl Acetate | Polymer Resin Matrix |
| EMA - Ethylene Methyl Acrylate | Polymer Resin Matrix |
| EPDM - Ethylene Propylene Diene Monomer | Secondary polymer |
| Silicone RTV | Polymer Resin Matrix |
| DEHA - Bis(2-ethylhexyl) adipate | Plasticizer |

Similarly, Table 2 below shows a list of exemplary additives capable of increasing the thermal conductivity of one or more base polymers. The thermal conductivity of each of these exemplary additives is also listed.

TABLE 2

Exemplary additives for use in manufacturing thermally conductive materials.

| Material | Thermal Conductivity (W/mK) |
|---|---|
| Graphite Fibers | 900 |
| Boron Nitride | 1055 |
| Zinc Oxide (ZnO) | 50 |
| Multi-walled carbon nanotubes | ~3000-3500 |
| Graphene | 3846 |

In at least one embodiment of the present disclosure, one or more base polymers are compounded with one or more additives to produce a thermally conductive material. Such compounding may be achieved via, for example, a twin screw-extruder compounding machine or any other method or apparatus. It should be appreciated that the aforementioned thermally conductive material is composite in nature.

It should further be appreciated that the overall thermal conductivity of the composite material depends on the composition of both the one or more base polymers and the one or more additives (which may be expressed experimentally by plotting the relationship between composition and conductivity), as well as the distribution of the additives in the base polymers in the resulting composite material. Internal distribution and homogeneity of the additive in the thermally conductive material may be tested through, for instance, microscopic analysis, mechanical testing, and the like.

An exemplary thermally conductive material is shown in FIG. 1. As shown, each pellet of material 100 is less than 5 mm. in diameter, such as, for instance, approximately 3.5 mm. in diameter. One of skill in the art will appreciate that pellet size depends on the method of manufacturing the pellets, including, for example, the specific extrusion machine used and the mechanism used to slice the pellets.

Figure 2A:
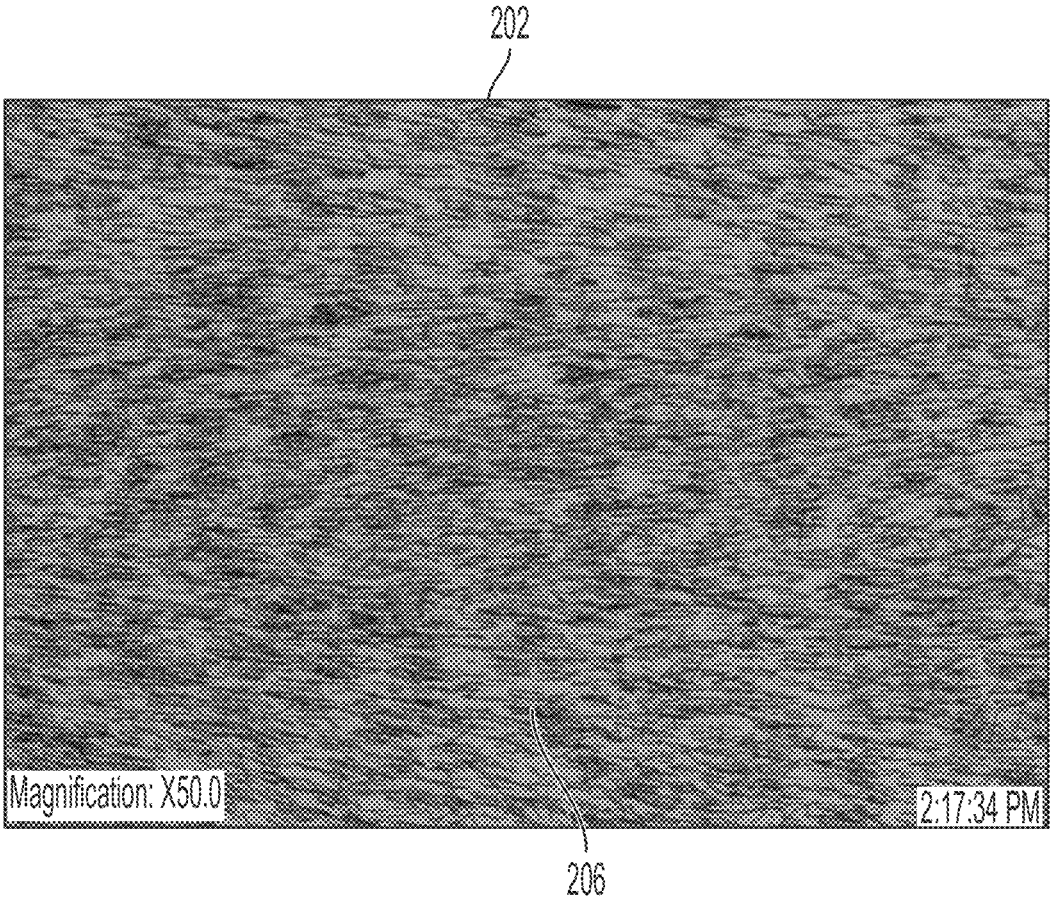
FIGS. 2A-B are cross-sectional views of a thermally conductive material comprising EVA polymer and 8% by weight graphite fiber (FIG. 2A) and a thermally conductive material comprising EVA polymer and 12% by weight graphite fiber (FIG. 2B), each according to at least one embodiment of the present disclosure.
Figure 2B:
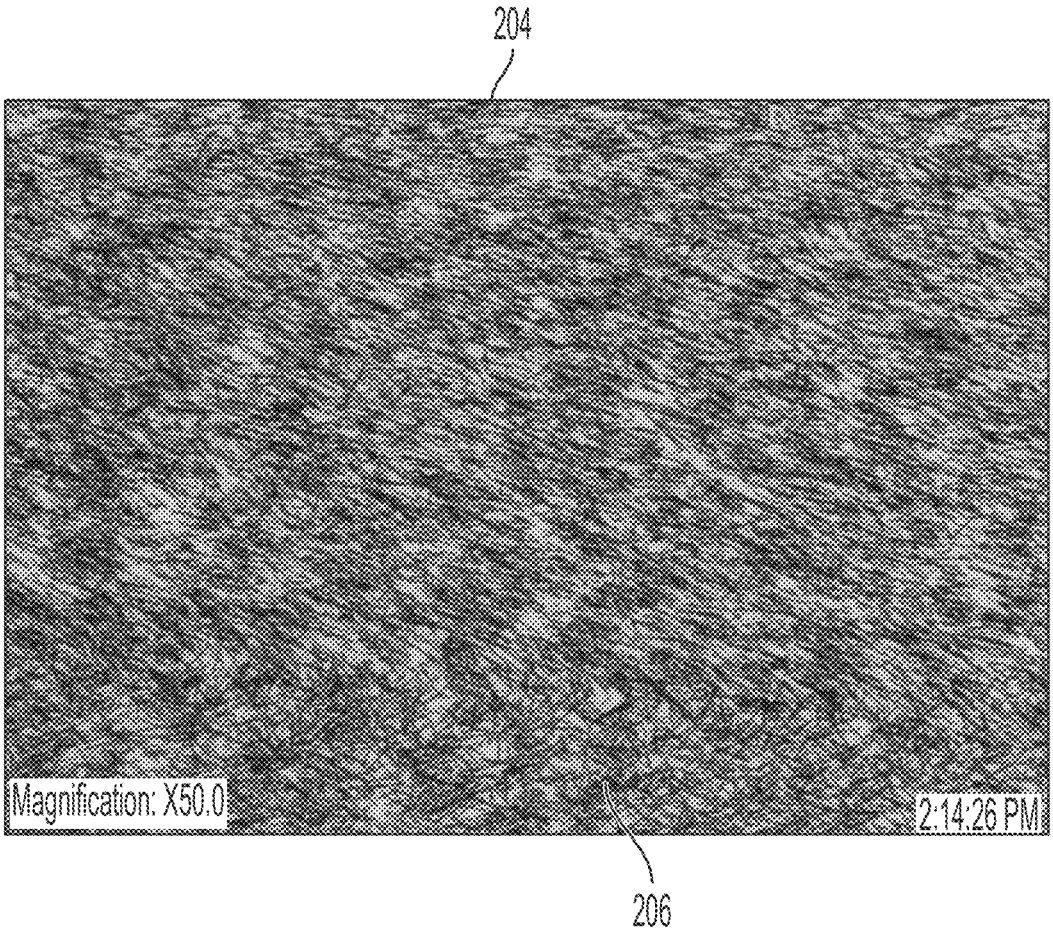

In at least one embodiment of the disclosure, a combination of EVA polymer (as the base polymer) and graphite fibers (as the additive) is used to produce thermally conductive material. FIGS. 2A and 2B display microscopic views of two such formulations. The first formulation 202 contains 8% by weight graphite fibers (FIG. 2A) and the second formulation 204 contains 12% by weight graphite fibers (FIG. 2B). The graphite fibers 206 can clearly be seen in both formulations, and one of skill in the art will appreciate that the uniform distribution of such fibers is important for isotropic thermal and mechanical properties, such as, for example, hardness and thermal conductivity, both important properties in choosing a formulation for the thermally conductive material. A skilled artisan will recognize a uniform distribution, such as the one shown, from a non-uniform distribution, which presents as distinct dark regions that have a high density of fibers.

It should further be appreciated that a different percentage by weight of graphite fibers may be used in combination with EVA polymer to create a range of thermally conductive materials with different properties. Purely as non-limiting examples, the percent by weight of graphite fibers may range from 8% up to 40%.

Table 3 below shows the hardness of various thermally conductive materials that were produced using a combination of EVA polymer and different percentages of graphite fibers. As can be seen below, the hardness of each of the thermally conductive materials listed is compared to EVA polymer by itself. The hardness values shown in Table 3 were measured using a durometer (Shore A, IAW ASTM D2240). It should be appreciated that, in addition to hardness, other physical properties can be tested using methods well-known in the art, such as ASTM D638 for mechanical properties.

TABLE 3

Measured hardness data for various thermally conductive materials containing EVA polymer and graphite fiber.

| Material | Hardness (Shore A) |
|---|---|
| Ethylene vinyl acetate (EVA) | 63 ± 3 |
| 8 wt % Graphite Fiber + EVA | 65 ± 3 |
| 10 wt % Graphite Fiber + EVA | 68 ± 5 |
| 12 wt % Graphite Fiber + EVA | 70 ± 2 |
| 20 wt % Graphite Fiber + EVA | 75 ± 7 |
| 30 wt % Graphite Fiber + EVA | 78 ± 5 |
| 40 wt % Graphite Fiber + EVA | 81 ± 4 |

As is apparent from Table 3, the thermally conductive materials using EVA with 8% to 12% graphite fiber have hardness measurements most comparable to EVA polymer alone. Higher graphite fiber percentages (20%, 30%, and 40%) show increased hardness in the range of 70-90 Shore A. One of skill in the art will appreciate that the +/− values in Table 3 may refer to the standard deviation of measured values. Thus, when factoring in significant digits, the hardness of the 8% graphite fiber to 40% graphite fiber formulations in the above table may range from 60-90 Shore A. Specifically, the hardness of the 8% and 12% graphite fiber formulations may range from 60-75 Shore A. It should also be appreciated that graphite fiber percentages in between those shown in the above table are possible, and can produce any hardness in the range of 60-90 Shore A.

Figure 3:
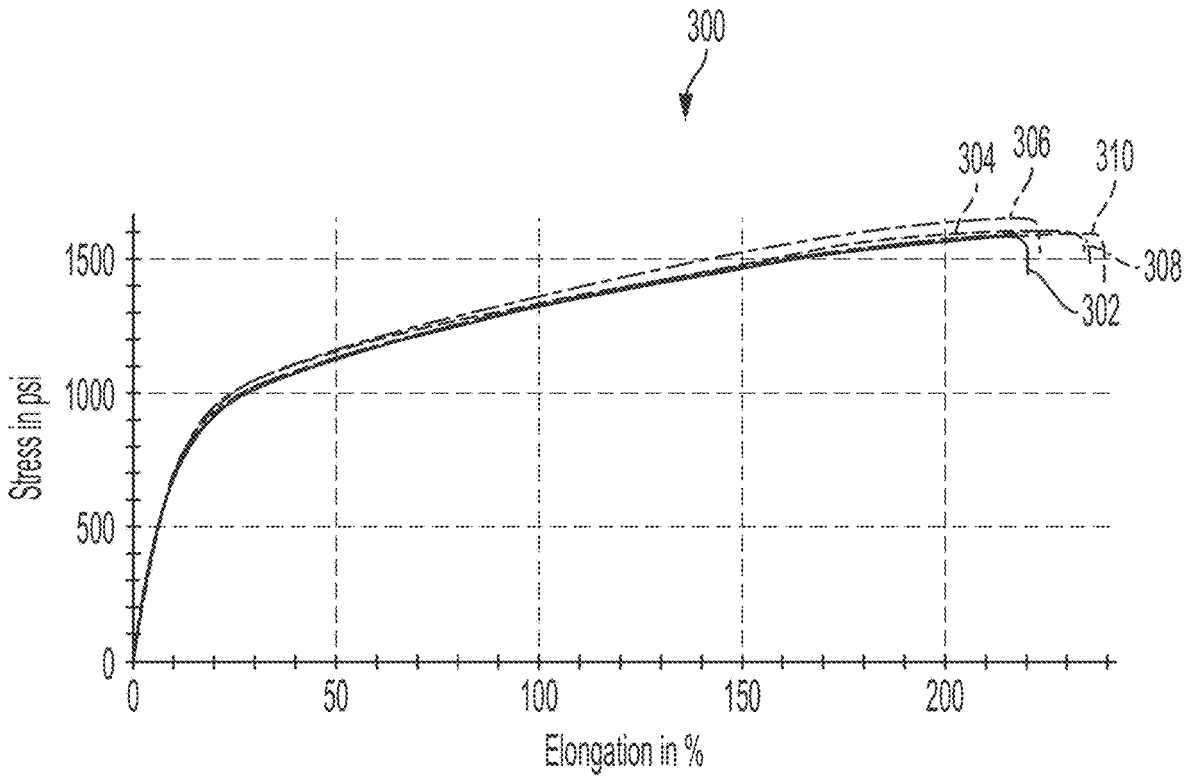
FIG. 3 is a chart illustrating the tensile strength profile of a thermally conductive material comprising EVA polymer and 8% by weight graphite fiber, according to at least one embodiment of the present disclosure.

Turning now to FIG. 3, a tensile strength profile 300 is shown with percent elongation on the X-axis and stress in pounds per square inch (psi) on the Y-axis. The profile shows different samples of a thermally conductive material comprising EVA polymer and 8% by weight graphite fiber. Each of the samples 302, 304, 306, 308, and 310 performs similarly, with a maximum elongation of more than 200% and a maximum stress level of over 1500 psi.

Further evaluations of (1) a material comprising EVA polymer and 8% by weight graphite fiber and (2) a material comprising EVA polymer and 12% by weight graphite fiber are displayed in Table 4 below. Specifically, the table shows, inter alia, the tensile stress data and break stress data for the aforementioned two materials as compared to EVA polymer by itself.

TABLE 4

Mechanical test data for EVA polymer as compared to (1) EVA polymer with 8% by weight graphite fiber and (2) EVA polymer with 12% by weight graphite fiber.

| Sample/Property | Tensile Stress (psi) | Elongation ($\varepsilon_M$, %) | Break Stress (psi) | Elongation ($\varepsilon_B$, %) |
|---|---|---|---|---|
| EVA | 1540 ± 25 | 260 ± 5 | 1470 ± 20 | 260 ± 5 |
| EVA + 8 wt % Graphite Fiber | 1600 ± 27 | 220 ± 8 | 1470 ± 51 | 230 ± 8 |
| EVA + 12 wt % Graphite Fiber | 1630 ± 23 | 200 ± 6 | 1500 ± 20 | 210 ± 8 |

As can be seen from the above table, the combination of EVA polymer with both 8% by weight graphite fiber and 12% by weight graphite fiber results in increased tensile stress and break stress by about 3-6%, as compared to EVA polymer alone. As with Table 3, one of skill in the art will appreciate that the +/− values in Table 4 may refer to the standard deviation of measured values. Thus, when factoring in significant digits, the ranges of, e.g., the 8% graphite fiber formulation may be 1570 to 1630 psi (tensile stress), 210% to 230% elongation (EM), 1410 to 1530 psi (break stress), and 220% to 240% elongation (EB). Similarly, the ranges of the 12% graphite fiber formulation may be 1600 to 1660 psi (tensile stress), 190% to 210% elongation (cm), 1480 to 1520 psi (break stress), and 200% to 220% elongation (EB). Again, it should be appreciated that graphite fiber percentages in between 8% and 12% are possible, and can produce values for tensile stress, elongation (EM), break stress, and/or elongation (EB) that are in between the ranges shown in Table 4.

Figure 4:
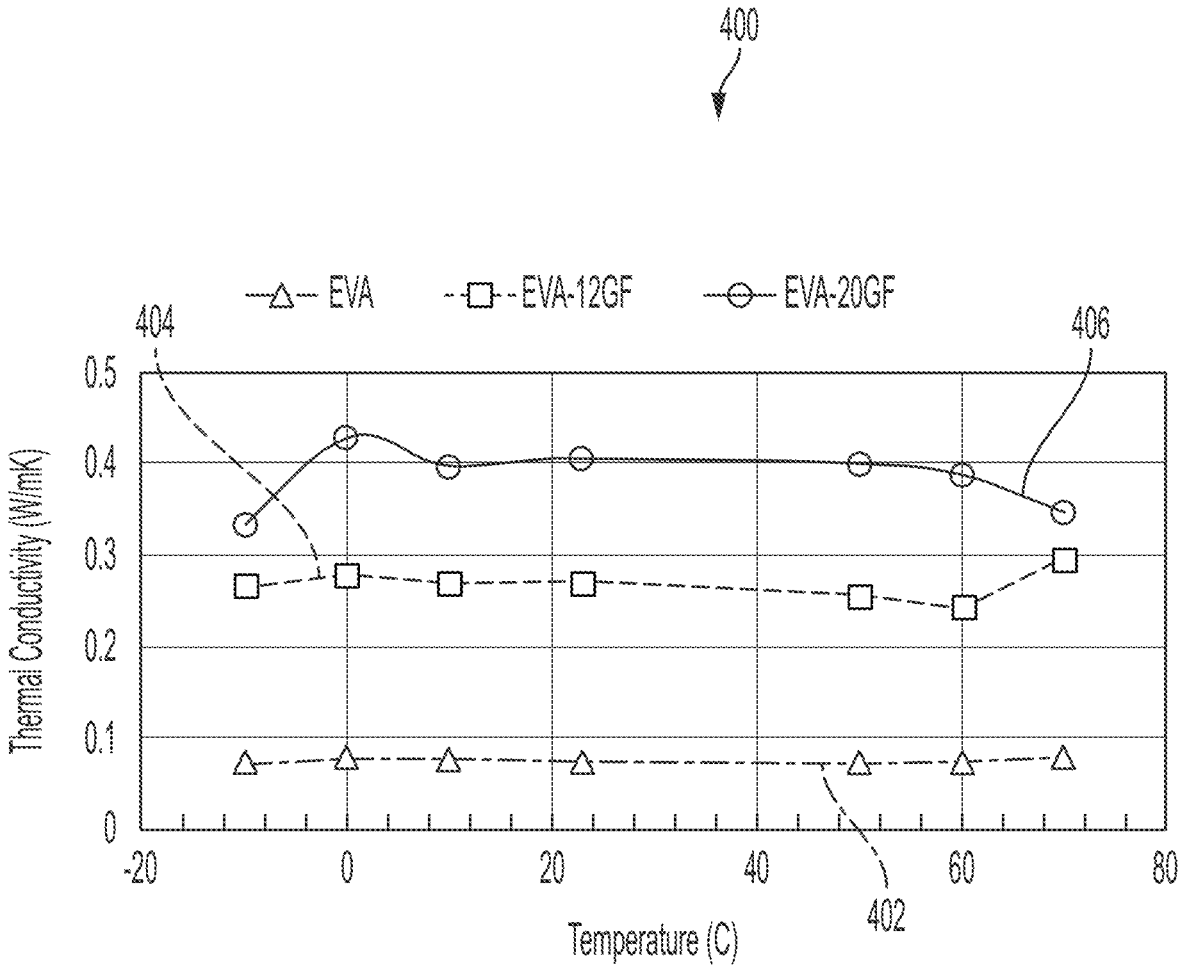
FIG. 4 is a chart illustrating the thermal conductivity at various temperatures of (1) EVA polymer alone, (2) a material comprising EVA polymer and 12% by weight graphite fiber, and (3) a material comprising EVA polymer and 20% by weight graphite fiber, each according to at least one embodiment of the present disclosure.

Thermal conductivity of the aforementioned, and other materials can be evaluated using methods and techniques, such as, for instance, the Laser Flash Technique (ASTM E1461 Thermal Diffusivity by the Flash Method). FIG. 4 is a graph 400 that displays the thermal conductivity at different temperatures of (1) EVA polymer alone (402), (2) a material comprising EVA polymer with 12% by weight graphite fiber (404), and (3) a material comprising EVA polymer with 20% by weight graphite fiber (406).

At all temperatures tested, FIG. 4 shows that the combination of EVA polymer with 12% by weight graphite fiber (404) results in an increase in thermal conductivity from <0.1 W/mK (for EVA polymer alone) to almost 0.3 W/mK (specifically, 0.25 to 0.3 W/mK). Composite material with EVA polymer and 20% by weight graphite fiber (406) exhibits even greater thermal conductivity, in the range of about 0.4 W/mK (specifically, 0.33 to 0.42 W/mK).

Although an increase in the percentage of graphite fiber may result in an increase in thermal conductivity, such an increase also results in increased hardness, as shown in Table 3. An increased hardness may make a thermally conductive material harder to work with, and harder to integrate into thermoregulatory apparel, such as, for instance, a cooling vest.

Therefore, one or more embodiments of the present disclosure comprise thermally conductive materials that include one or more plasticizers and/or one or more secondary polymers. Many plasticizers and/or secondary polymers are non-toxic and approved for proximity to humans, including, for example, for wearable products. These include, as non-limiting examples, EPDM and DEHA. The one or more plasticizers and/or one or more secondary polymers act to decrease the hardness of the thermally conductive material while maintaining, or increasing, its thermal conductivity.

Table 5 sets forth various exemplary formulations that comprise Ethylene Propylene Diene Monomer (EPDM) rubber to reduce hardness and/or Bis(2-ethylhexyl) adipate (DEHA) for improving flexibility. All percentages are by weight.

TABLE 5

Exemplary formulations of various thermally conductive materials developed for improved thermal conductivity and flexibility.

| Material Composition | Hardness (Shore A) | Thermal Conductivity at 23° C. (W/mK) |
|---|---|---|
| 70% EVA, 15% Graphite, 15% DEHA | 76-78 | 0.295 |
| 65% EVA + 5% EPDM, 15% Graphite, 15% DEHA | 70-72 | 0.302 |
| 70% EMA, 15% Graphite, 15% DEHA | 60-62 | 0.342 |
| 65% EMA, 15% Graphite, 20% DEHA | 65-67 | 0.290 |

As can be seen from Table 5, the thermally conductive material with EVA and graphite that also comprises EPDM has reduced hardness, but the same or slightly greater thermal conductivity, as compared to a similar material with EVA and graphite that did not have EPDM. Additionally, Table 5 shows that a formulation utilizing EMA (70% EMA, 15% graphite, 15% DEHA) had further reduced hardness but the best thermal conductivity of the three formulations represented.

The addition of DEHA, which is commonly used in plastic products for improving the flexibility of rigid polymers, also helps in reducing hardness. DEHA is the di-ester of 2-ethylhexanol and adipic acid with the formula $(CH_2CH_2CO_2C_8H_{17})_2$. The effect of DEHA on hardness is shown below in Table 6.

TABLE 6

Effect of various percentages of DEHA (by weight) on hardness (Shore A).

| DEHA (wt %) | Hardness (Shore A) |
|---|---|
| 0 | 70 ± 5 |
| 7.5 | 57 ± 3 |
| 15 | 47 ± 5 |
| 30 | 30 ± 5 |
| 40 | 25 ± 5 |

As is apparent from Table 6, an increase in DEHA, up to and including 40% by weight, results in a concomitant and continuing reduction in hardness measurements (Shore A).

Figure 5A:
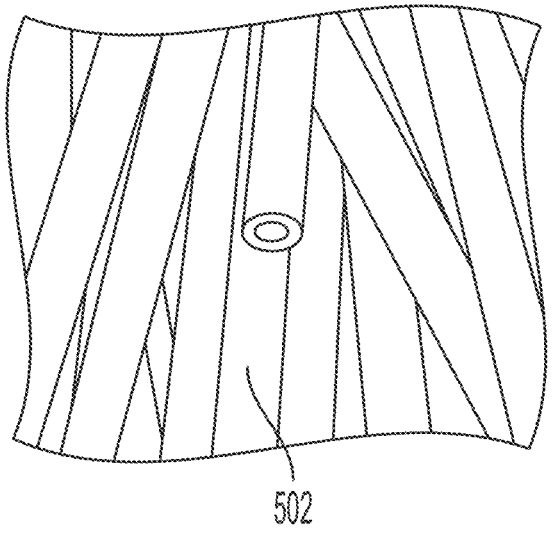
FIGS. 5A-B are depictions of extruded tubes (FIG. 5A) and sheets (FIG. 5B) made from a thermally conductive material comprising EVA polymer and graphite fiber, according to at least one embodiment of the present disclosure.
Figure 5B:
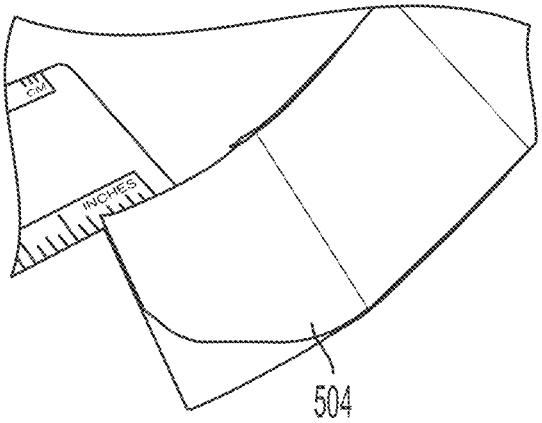

In at least one embodiment of the present disclosure, the formulations of thermally conductive materials mentioned above, as well as other formulations, were extruded into tubes and/or sheets using one or more methods. These formulations included (1) 70% EVA, 15% graphite, and 15% DEHA, and (2) 70% EMA, 15% graphite, and 15% DEHA. The second formulation is preferred for the application of cooling vest tubing based on the combination of hardness and temperature conductivity per Table 5. With particular reference to FIG. 5, tubes 502 and sheets 504 made from a thermally conductive material comprising EVA polymer and graphite fiber are shown. The thermally conductive tubes and/or sheets can then be utilized to create thermoregulatory apparel, including, for example, cooling vests. Purely as a non-limiting example, a plurality of thermally conductive tubes, such as the tubes 502, may be stitched and/or sewn into stretchable fabric, which can then take the shape of various wearable apparel. The use of such thermally conductive tubes enables better heat regulation and cooling for the wearer of the apparel while allowing the wearer freedom of movement.

It should be appreciated that the thermally conductive materials described herein are an improvement over commercially-available products because, at minimum, the materials described herein provide thermal conductivity that is on par with, or better than, the 0.1-0.2 W/mK provided by commercially-available products, in addition to providing improved flexibility. Further, combining additives with commercially-available products does not result in a material that can be extruded into tubes and has properties (e.g., burst strength, mechanical strength, thermal resiliency, and the like) desirable for use in a wearable thermoregulatory device or apparel.

Additional embodiments of the present disclosure are directed towards devices, systems, and methods for cooling and/or thermoregulation. In particular, at least one embodiment relates to wearable thermoregulatory devices and/or systems, including, for instance, apparel, backpacks, and the like.

In some embodiments, a cooling vest is disclosed that is wearable by human users to cool down their body temperature and/or to keep their body temperature below a certain value. The cooling vest, in accordance with one or more embodiments, comprises tubing, though which coolant flows, arranged within the fabric used for the vest. This fabric has a 4-way stretch, which is a term, familiar to one of skill in the art, for a fabric that is capable of stretching both crosswise and lengthwise. Non-limiting examples of such 4-way stretch fabrics include spandex and elastane. One of skill in the art will recognize that 4-way stretch fabrics have been incorporated into a variety of clothing, including, but not limited to, sports apparel, such as swimwear and leotards, general athletic wear, loungewear, and the like. This stretch of the fabric enables increased contact of the tubes with the skin, reducing any airgaps that may be present.

Figure 6A:
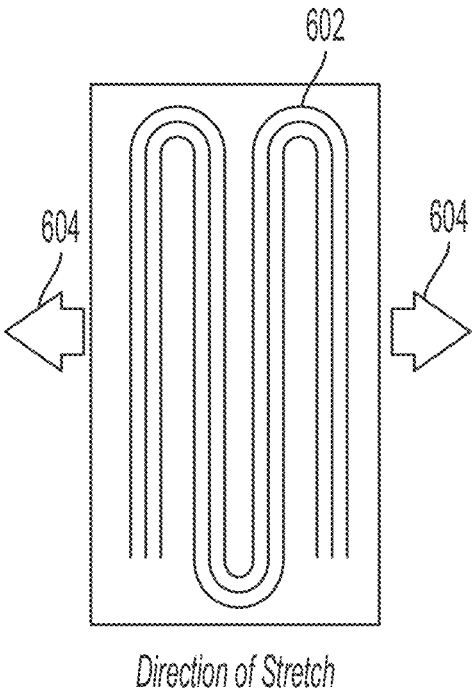
FIGS. 6A and 6B show a depiction of an exemplary set of tubing (FIG. 6A) and thermoregulatory apparel comprising such tubing (FIG. 6B), according to at least one embodiment of the present disclosure.
Figure 6B:
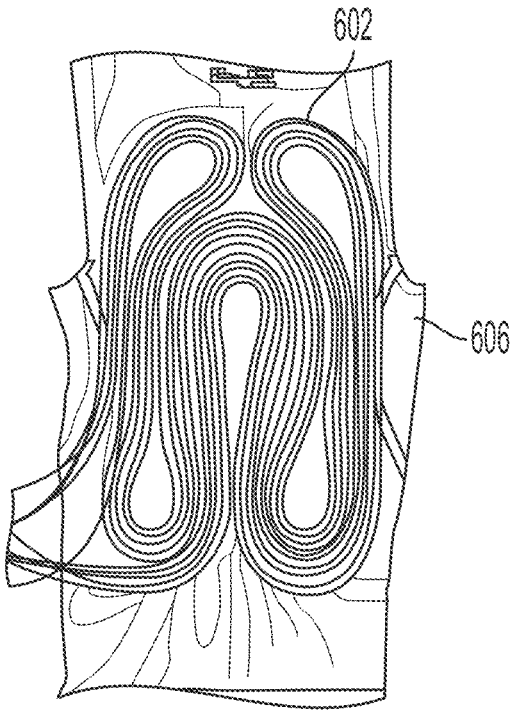

Exemplary versions of the cooling vest, including the layout of the tubing, are shown in FIGS. 6A-6B. In particular, FIG. 6A is an illustrated depiction of a sinusoidal layout (also referred to herein as a "serpentine" layout) of tubing 602. The term "sinusoidal layout" herein refers to a layout having the form of alternating peaks and valleys. It should be appreciated that such peaks and valleys need not be symmetric, regular, or periodic. The layout may also comprise a nested sinusoidal arrangement (e.g., in which the alternating peaks and valleys of certain portions of tubing are nested next to the alternating peaks and valleys of other portions of tubing). A skilled artisan will appreciate that this serpentine layout enables stretching of the cooling vest from side-to-side, that is, along the horizontal axis of the cooling vest, as depicted by the arrows 604 in FIG. 6A. It will further be appreciated that such a stretch is important in enabling movement of a user that is wearing the cooling vest, as well as enabling the vest to be a unisex garment that can fit properly on the torsos of users with different body sizes and shapes. This layout of the tubes eliminates possible constraints to breathing while the fabric conforms to the body.

FIG. 6B illustrates an exemplary serpentine layout of the tubing 602 overlaid on an exemplary four-way stretch fabric 606, before the tubing and the fabric are combined to form the cooling vest.

One of skill in the art will appreciate that both the tubing layout and the four-way stretch fabric permit stretching in the horizontal direction (e.g., either to the left or to the right of the vest, as illustrated). It should further be appreciated that the fabric of the vest (which may include, for instance, fabric 606), as well as other wearable, thermoregulatory apparel comprising an embodiment of the present disclosure, can be designed and/or chosen based on human physiology and torso structure such that the fabric has the same or a similar amount of horizontal stretch as the serpentine layout of the tubing.

Figure 7A:
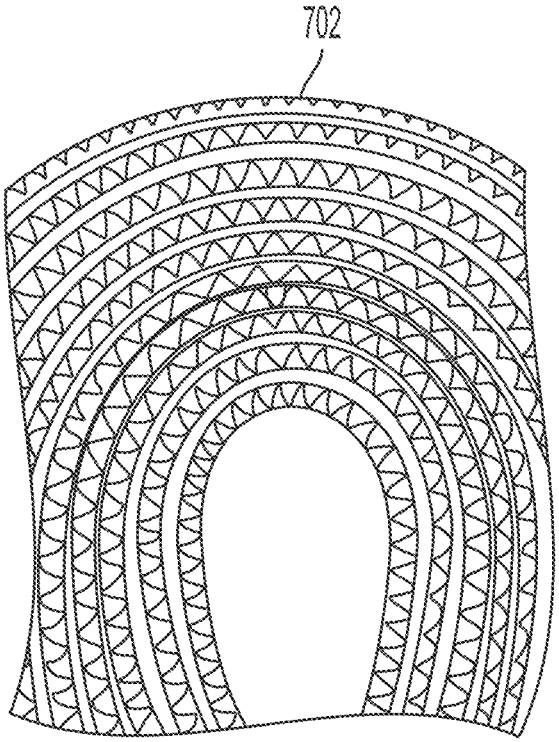
FIGS. 7A and 7B depict an exemplary stitching method for securing tubing to apparel fabric shown from the outside (FIG. 7A) and inside (FIG. 7B), according to at least one embodiment of the present disclosure.
Figure 7B:
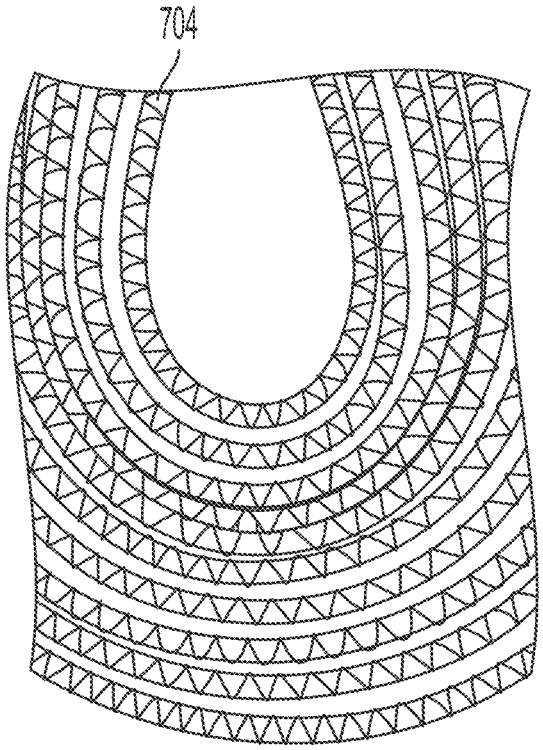

In one or more embodiments of the present disclosure, the tubing is sewn on the fabric used for the apparel using a modified cording foot, thereby allowing for the minimum bend radius of the tubing on the fabric. FIGS. 7A and 7B depict examples of such a modified cording foot 702 and 704. This stitching pattern enables the elimination of snags and hazards, and further allows for spacing of the tubing that permits maximum thermoregulation, including, for example, maximum heat extraction from the surface of the user's body. Purely as a non-limiting example, the pitch between different sections of the tubing may be between 6.6 mm and 20 mm, and further may be 6.6 mm±1 mm. Generally, greater spacing increases efficiency of cooling (cooling/ft of tubing), while closer spacing increases maximum cooling at the loss of efficiency.

As stated above herein, it should be appreciated that the flexibility of the tubing is balanced with the stretch of the fabric. The stretching of the fabric increases contact between the tubing and the body of the user by flexing the tubes to fit the contours of the body. Therefore, tubing that is insufficiently flexible results in the fabric being pulled away from the body, thereby limiting the apparel's thermoregulatory capabilities, while tubing that is too flexible results in the flow of coolant being impeded. Purely metallic tubing is thus generally not useful for this application, while a range of polymer and rubber tubing demonstrate acceptable cooling characteristics when used in the system. Other types of tubing may also be used in the system, including, for instance, metal-infused tubing (e.g., tubing made with copper-infused elastomeric material), and elastic tubing.

While the use of modular cooling cartridges in conjunction with the cooling vest is described below, such a vest may also be used in conventional prior-art portable cooling systems, utilizing, for example, a portable vapor compression unit and battery.

Figure 8:
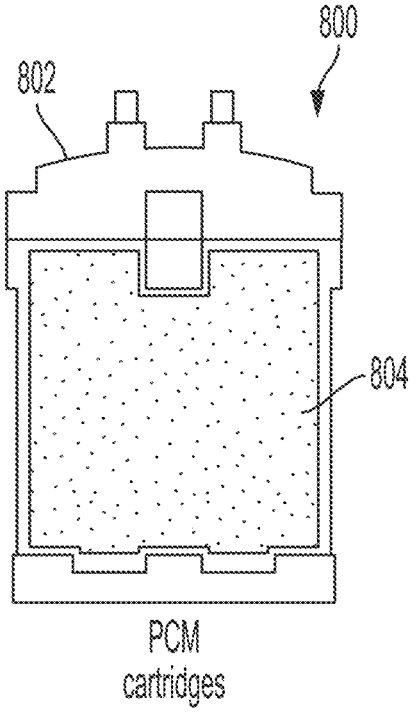
FIG. 8 is a depiction of an exemplary cartridge with a Phase Control Material (PCM), according to at least one embodiment of the present disclosure.

The cooling vest or other wearable, thermoregulatory form factor may further comprise one or more cartridges that each provides a capacity for controlling temperature in different conditions and in different use scenarios. An exemplary cartridge 800 designed for cooling is shown in FIG. 8, which depicts a sealed container 802 that contains a Phase Change Material (PCM) 804. The cartridge 800 will be described in more detail herein with particular reference to the one or more embodiments of the present disclosure that comprise a cooling vest or other cooling apparel. A skilled artisan will appreciate that the coolant circulating through the tubing will eventually have reduced or limited cooling ability, since the coolant absorbs heat generated by the user's body. Therefore, the coolant must be cooled and/or replaced such that the cooling ability of the coolant is renewed, thereby allowing the coolant to continue absorbing heat from the user. The cartridge generally enables such cooling and/or replacement of coolant.

In at least one embodiment, a wearable cooling system is described. This system comprises a wearable item (e.g., a cooling vest) comprising a fabric portion (which may include, for instance, fabric 606) and a first section of tubing (which may include, for instance, tubing 602, 702, and/or 704) secured to the fabric portion so as to contact a user's skin while the user is wearing the item, at least one cartridge (which may include, for instance, cartridge 800) comprising a second section of tubing and a phase change material (PCM) (such as, for example, PCM 804), wherein the PCM is configured to be in thermal contact with coolant passing through the second section of tubing, and one or more connectors for connecting the first section of tubing with the second section of tubing. The first and/or second sections of tubing may be sewn into the fabric portion, as described above herein. Additional securing and/or attachment mechanisms are known in the art and include, for instance, adhesion via an adhesive, clips (e.g., clips 1260 and/or 1262), pins, fasteners (e.g., hook-and-loop fasteners, hook-and-pile fasteners), and the like. Further, the fabric portion may have any of the stitching patterns described above herein, such as, for instance, a modified cording foot.

Figure 9:
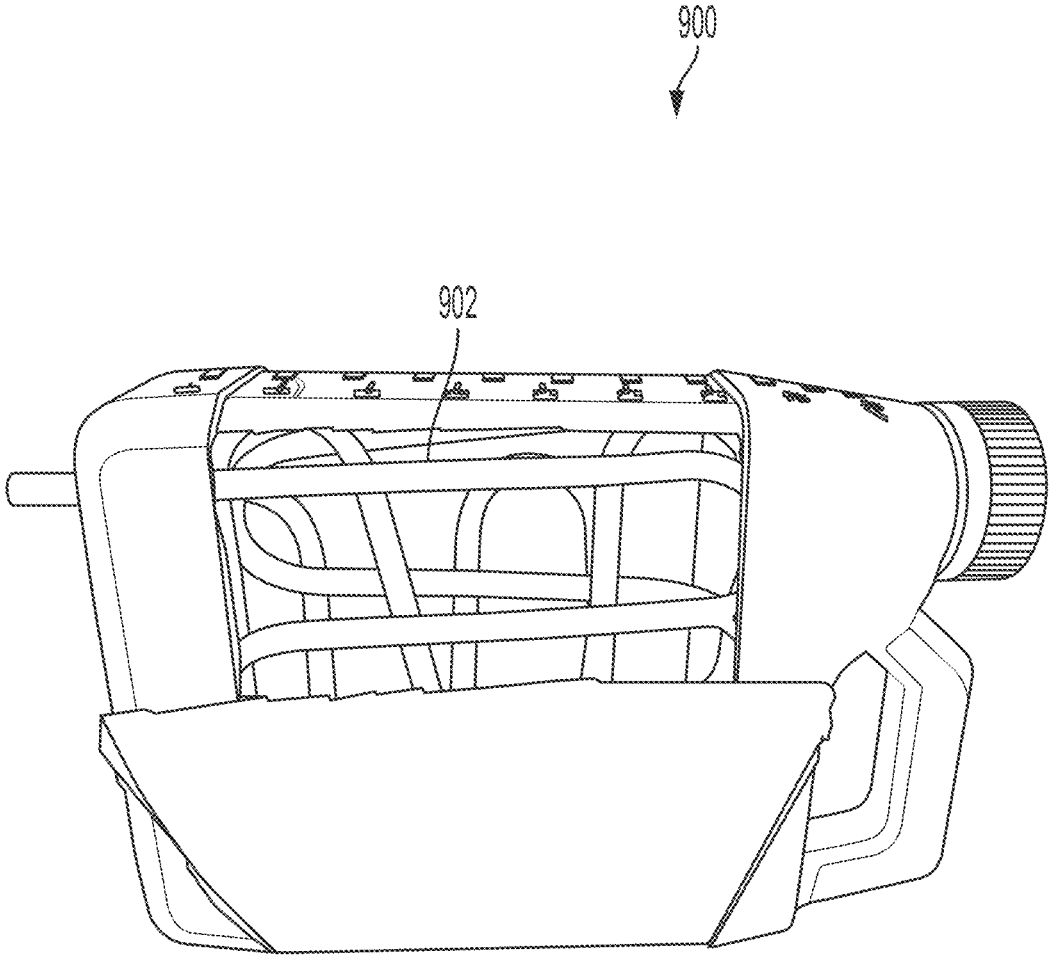
FIG. 9 is a depiction of a rudimentary cartridge, showing the internal tubing, according to at least one embodiment of the present disclosure.

The cartridge may comprise tubing (e.g., the second section of tubing) made of the same or a different material as the tubing in the vest (e.g., the first section of tubing), and may be configured so that the user may flow the coolant from the tubing in the vest into the tubing in the cartridge. FIG. 9 is a depiction of an exemplary cartridge 900, showing the internal tubing 902. PCM would fill the remainder of the container surrounding the tubing.

As the coolant flows through the cartridge, the low-temperature PCM surrounding the tubing reduces the temperature of the coolant by absorbing heat from the coolant through the walls of the tubing via conduction, thereby renewing/increasing the coolant's cooling ability. After the coolant flows through the cartridge, and the cooling ability of the coolant is increased, the coolant may then be passed from the cartridge back into the tubing in the vest. The coolant may then recirculate through the vest until the temperature of the coolant needs to be reduced again.

In certain embodiments, the coolant is either water or water mixed with up to 30% glycol by weight, such as 10% glycol, and the PCM is ice. Any known coolant may be utilized. Various known PCM materials may also be used, such as paraffins, salt hydrates, etc. PCM is useful for this application because as it changes phase from solid to liquid, the liquid maintains the same temperature until all the solid has changed phase. Thus, it offers a constant and predictable level of cooling for an extended period of time. Nevertheless, in some embodiments another material may be substituted for a PCM. For example, a fluid or solid material that does not undergo phase change in normal operating temperatures may be cooled to a low temperature and used instead of a PCM.

In some embodiments, the apparel may be used for heating a wearer instead of cooling. In such a case, the chosen PCM may change to solid state near and above human body temperature (e.g., —110° F.).

It should be appreciated that a variety of different cartridges may be used with the cooling vest or other wearable cooling device and/or system, depending on the user's needs and the desired temperature and duration of cooling. It should further be appreciated that the specific thermoregulatory properties of a given cartridge depends on the PCM contained within. That is, each cartridge may have a different cooling ability depending on a variety of factors, including, for example, a different PCM, a different volume for holding the PCM, and the like.

Figure 10:
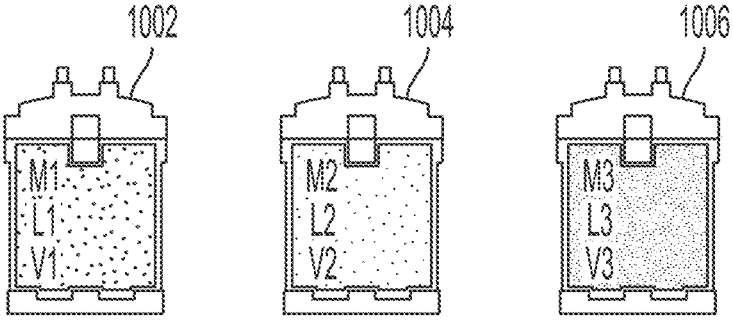
FIG. 10 is a depiction of three exemplary cartridges each with a different PCM, tube length, volume, cooling capacity, and rate of cooling, according to at least one embodiment of the present disclosure.

This variety of factors is shown with particular reference to FIG. 10, which depicts three exemplary cartridges (Unit 1 (1002), Unit 2 (1004), and Unit 3 (1006)), each with a different PCM in the cartridge (M1 for Unit 1, M2 for Unit 2, and M3 for Unit 3), a different length of tubing in the cartridge (L1 for Unit 1, L2 for Unit 2, and L3 for Unit 3), a different cartridge volume (V1 for Unit 1, V2 for Unit 2, and V3 for Unit 3), a different cooling capacity (W1 for Unit 1, W2 for Unit 2, and W3 for Unit 3), and a different rate of cooling. Cooling capacity may be measured in Watts*minutes, while rate of cooling may be measured in Watts. As shown, the general formula for the duration of cooling is equal to the ratio of the cooling capacity (W1, W2, and W3, respectively) to the rate of cooling (R1, R2, and R3, respectively). Thus, the cooling duration of each of the three different cartridges depends on both the cooling capacity of each cartridge (which is affected, in part, by the type of PCM in each cartridge and cartridge (e.g., PCM) volume) and the rate of cooling (which, as described above herein, is affected, in part, by the amount of tubing associated with each cartridge). It should therefore be appreciated that a user may alter the amount of cooling he or she receives in the cooling vest by choosing a specific cartridge with a combination of factors that suits his or her needs. Purely as a non-limiting example, two cartridges with identical volume, but having two different lengths of tubing inside, can provide a different outlet temperature of the coolant, thereby leading to increased cooling.

It should further be appreciated that the operating range of any coolant used should be lower than the freezing temperatures of the material in the cartridge. This will allow the same coolant to be used across the entire system without requiring priming or introduction of air into the system. In at least one embodiment of the present disclosure, the coolant is circulated through the tubing in the cooling vest without the need for a power source, such as, for example, a battery pack. Instead, a pump is used to circulate coolant, including, for instance, a diaphragm pump, a peristaltic pump, and/or other similar pumps. A diaphragm pump, for example, has the advantage of not requiring priming. In at least one embodiment, a manual or biomechanical pump is used to circulate the coolant in the system creating a passive system.

Figure 11:
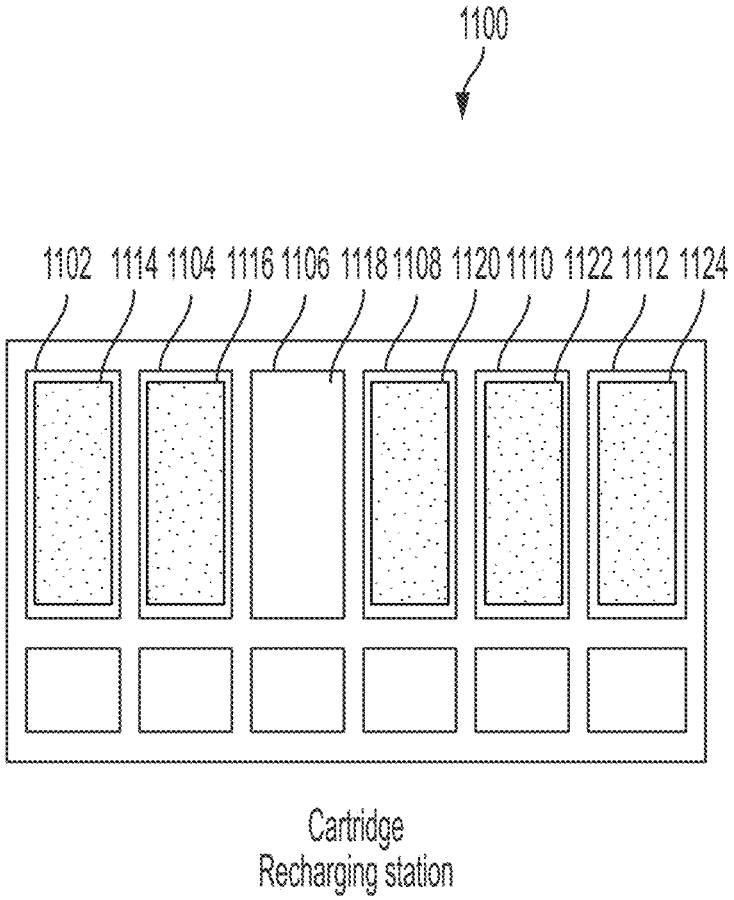
FIG. 11 is a depiction of an exemplary cartridge recharging station, according to at least one embodiment of the present disclosure.

Turning now to FIG. 11, an exemplary recharging system 1100 for one or more cartridges 1102, 1104, 1106, 1108, 1110, and 1112 is shown. Each of the cartridges has attendant PCM 1116, 1118, 1120, 1122, and 1124, respectively. This system 1100 will be described in more detail with particular reference to the one or more embodiments of the disclosure that comprise cartridges that provide cooling. The recharging system may therefore be used to recharge the PCM (e.g., empty PCM 1118) within a cartridge (e.g., cartridge 1106) once that PCM's ability to increase the cooling ability of coolant circulating through the cartridge tubing has diminished and/or ceased. One of skill in the art will realize that the PCM will have its cooling ability diminish since it absorbs heat from the coolant when the PCM is recharging the coolant (e.g., increasing the cooling ability of the coolant) and may also absorb heat from the environment, although insulation of the cartridge may be utilized to reduce such heat loss. Thus, the PCM itself must eventually be recharged. The recharging system may be used to recharge one or more cartridges at a time by, for example, slotting the one or more depleted cartridges into the recharging system and running a coolant through the cartridges that is colder than the PCM currently inside the one or more depleted cartridges. This coolant may be the same as, or different from, the coolant used in the cooling vest. Purely as a non-limiting example, in an embodiment in which the coolant used in the cooling vest is water and 10% glycol and the PCM is ice, the cartridge recharging system may run that same coolant (water and 10% glycol) at a lower temperature than the ice currently in a depleted cartridge in order to recharge the PCM (e.g., reconstitute the ice from melt water in the cartridge, and eventually reduce the temperature of the ice in the cartridge below freezing).

It should be appreciated that, in at least one embodiment, the cartridge recharger 1100 described above herein may be part of a wearable cooling system that comprises both the recharger and a cooling vest or other wearable, thermoregulatory apparel. The cartridge recharger may be configured to replace the PCM and/or restore cooling capacity of the PCM. To restore cooling capacity, the cartridge recharger may, for example, be configured to connect to, and flow, coolant through the tubing located in the cartridge to reduce the temperature of the PCM, thereby restoring the PCM's cooling capacity. After the coolant restores the PCM's cooling capacity, it may flow back into the cartridge recharger to be stored for further use and/or flow into the tubing inside the cooling vest. It should be appreciated that, in at least one embodiment, the cartridge recharger is capable of simultaneously recharging or replacing the PCM in two or more cartridges.

It should be appreciated that at least one embodiment permits high heat extraction from the body of the user through increasing body contact between the body and a cooling mechanism embedded in the apparel, such as, for example, the tubing. It should also be appreciated that one or more embodiments balances the need to thermoregulate the user with the need for the user to retain maximum mobility while wearing the apparel. Therefore, the thermoregulation of the apparel is balanced against the need of the fabric to properly stretch, which requires, in part, adequate flexibility in the tubing to enable such stretch.

It should additionally be appreciated that the weight of the wearable thermoregulatory devices and/or systems disclosed herein, including, for instance, the cooling vest disclosed herein, is lower than that of conventional commercial alternatives. This weight reduction is due, in part, to the use of the cartridges described herein that provide temperature regulation. Current cooling vests utilize battery packs or other mobile sources of power to provide cooling, and must be worn by the user. Purely as a non-limiting example, embodiments of the present disclosure comprise cartridges that each weigh around 2 lb., while the backpacks associated with current commercial cooling vests weigh around 7-8 lb.

Additional weight reduction may be had by utilizing lighter tubing than what is currently used. For instance, the tubing used in the cooling vest may be made of a thermally conductive material that comprises one or more base polymers and one or more substances that increase the thermal conductivity of the one or more base polymers. These one or more substances may comprise one or more additives that can include, for example, metal or ceramic additives, such as, for instance, graphite fibers. The thermally conductive material may also comprise a secondary polymer and/or a plasticizer, either or both of which serve to reduce hardness of the thermally conductive material.

The secondary polymer can include, for instance, ethylene propylene diene monomer (EPDM), and the plasticizer can include, for example, bis(2-ethylhexyl) adipate (DEHA). In the non-limiting example of a cooling vest, most of the system's tubing is located outside the cartridge, in the vest portion. Since tubing within the cartridge need not be flexible, tubing material may vary between the cartridge and apparel portions. For example, tubing material in a cartridge may be copper or another metal to provide a high rate of heat transfer and reduce the chances of kinking or blocked flow.

Figure 12B:
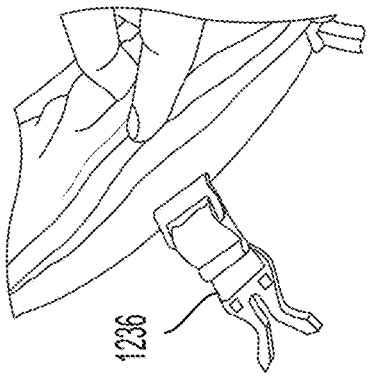
FIGS. 12A-12D are diagrams of a wearable cooling backpack shown from a front view (FIG. 12A) and with additional detail views of sternum-associated straps (FIGS. 12B-12C) and hip straps (FIG. 12D), according to at least one embodiment of the present disclosure.
Figure 12C:
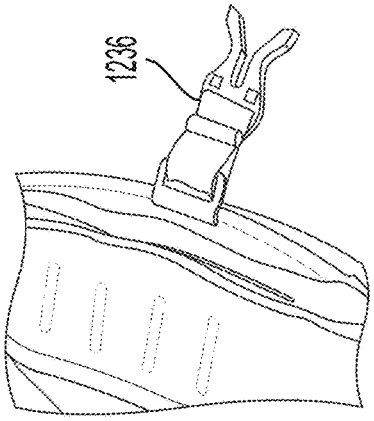
Figure 12D:
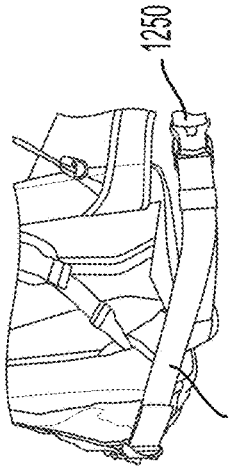
Figure 12A:
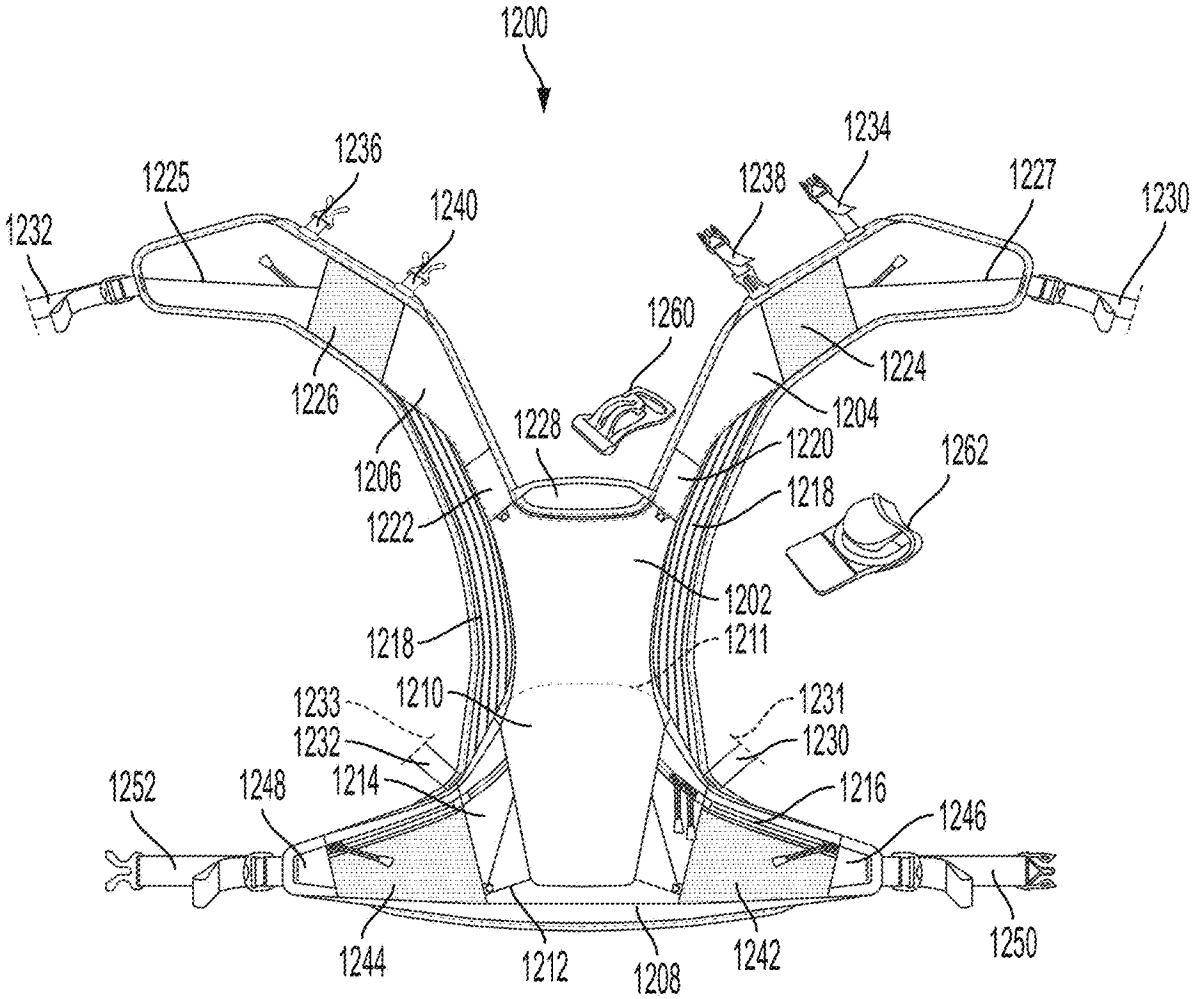

Turning now to FIG. 12A, a front view of cooling backpack 1200 according to at least one embodiment of the present disclosure is shown. The cooling backpack is wearable by a user in a manner similar to a conventional backpack, and comprises a central portion 1202, two shoulder straps 1204 and 1206, and a bottom portion 1208. The central portion is disposed between the two shoulder straps and the bottom portion. Further, the shoulder straps 1204 and 1206 are each connected to the central portion 1202 and extend away from the central portion. During use, the bottom portion 1208, can rest against the user's hip/lumbar region, extends from the central portion 1202, and is wider than the central portion. The shoulder straps may further comprise zipper flaps 1225 and 1227.

It should be appreciated that tubing 1218 runs throughout the cooling backpack 1200 to deliver coolant throughout the backpack. Accordingly, the tubing runs through the central portion 1202, each of the shoulder straps 1204 and 1206, and the bottom portion 1208. Such tubing may comprise, for instance, the thermoregulatory tubing described herein. It should further be appreciated that the tubing is sufficiently flexible to be incorporated into the backpack and move with the user's movements, as well as sufficiently strong so as to not be constricted or crushed, thereby ensuring flow of the coolant throughout the backpack while worn. Specifically, the tubing is strong enough (as measured by, e.g., crush strength of the tubing, as shown in further detail in FIG. 15) so that the portions of the tubing that run through the shoulder straps 1204 and 1206 are not constricted or crushed by the weight of the backpack bearing down on the user's shoulders while the backpack is worn. Specifically, the shoulder straps are designed and/or constructed such that the tubing running through the straps is not the load-bearing component. Tubing having an adequate crush strength further ensures that any load transferred to the tubing will not kink and/or pinch the tubing closed, and will therefore not stop the flow of the coolant through the tubing.

A main pocket 1214, which is covered by flap 1210 and which is disposed at or near the junction of the central portion and the bottom portion, comprises a space in the interior of the backpack that runs in a vertical dimension from line 1211 to the bottom portion 1208 of the backpack. The main pocket 1214 is openable via zipper 1216. However, a skilled artisan will appreciate that any other type of closure can be used to close the main pocket, including, for instance, buttons, clasps, connectors, clips, cords, and the like. The main pocket 1214 contains (1) a coolant reservoir such as a bladder (not shown), (2) a pump (not shown), and (3) a battery (not shown). The bladder may, in some embodiments, be a pouch or other container that is used to hold coolant. Such coolant may be one or more coolants, including, for example, water, ice, ice packs, cooling gel and/or gel packs, and the like. Both the pump and the battery may be of any type, for instance, the pump may be a submersible pump. It should be appreciated that the pump may also be physically located inside the bladder.

The aforementioned tubing 1218 is fluidly connected to the bladder, thereby enabling circulation of coolant throughout the backpack. Thus, in operation, the battery powers the pump, which circulates the coolant through the tubing, thereby providing thermoregulation (e.g., cooling) to the user wearing the backpack.

In some such embodiments, the bladder is detachable from the tubing 1218 and removable from the main pocket of the backpack. Such detachability may be provided by one or more devices and/or methods, including, for example, quick disconnectors that connect the bladder to the tubing. As a result, the user may remove the bladder from the backpack in order to insert new coolant into the bladder.

An elastic cord 1212 secures the flap 1210 to the cooling backpack. One of skill in the art will recognize that any other type of closure can be used to secure the flap, including, for instance, buttons, clasps, connectors, clips, zippers, and the like.

The cooling backpack 1200 also comprises a plurality of straps to secure the backpack to the user, similar to conventional backpacks. For instance, straps 1230 and 1232 extend from the shoulder straps 1204 and 1206, respectively to help secure the shoulder straps to the user. Dashed line 1231 represents where the two parts of strap 1230 meet. Similarly, dashed line 1233 represents where the two parts of strap 1232 meet. The straps 1230 and 1232 are therefore shown separated into these two parts on FIG. 12 solely for clarity. Additionally, two sternum straps 1234 and 1238 connect to straps 1236 and 1240, respectively. The sternum straps may further include hydration and/or other types of clips (e.g., clip 1260). When such sternum straps 1234 and 1238 are connected to straps 1236 and 1240, the sternum straps pass over the chest of the user, further helping secure the backpack to the user. Similarly, hip straps 1250 and 1252 extend from the bottom portion 1208 and connect together to help secure the backpack, and specifically the bottom portion of the backpack to the hip/lumbar region of the user. The hip straps may include, for instance, pull loops and buckles as known in the art for backpack straps. It should be appreciated that these straps 1250 and 1252 can connect together using mechanisms, including, for instance, clips, clasps, male-female connectors, and the like.

The cooling backpack 1200 further comprises a plurality of storage containers, similar to conventional backpacks. For instance, a central sleeve 1228 is disposed adjacent to the central portion 1202. This sleeve can be used to store items, including, for instance, a water bottle, thermos, and/or other types of containers. To enable the user to intake water or other fluids more readily while wearing the backpack, flaps 1220 and 1222 are disposed on the shoulder straps 1204 and 1206, respectively. A tube (e.g., hydration tube) or a straw can pass through these flaps so that a user can intake fluid from a water bottle, thermos, or other container stored in central sleeve 1228. Thus, the flaps 1220 and 1222 can comprise one or more passages that permit one or more items (e.g., the aforementioned tube(s)) to pass through. The flaps can additionally include one or more sewable clips (e.g., clip 1262). Additional storage is provided by mesh pockets 1224 and 1226, which are disposed on the shoulder straps 1204 and 1206, respectively, and by mesh pockets 1242 and 1244, which are disposed on the bottom portion 1208. The aforementioned mesh pockets may comprise one or more passages that permit one or more items to pass through, and may also include one or more portions of stretch mesh bound to the fabric of the backpack. Two accessory loops 1246 and 1248, on the bottom portion of the backpack, are also provided. These accessory loops may also comprise one or more passages that permit one or more items to pass through.

FIGS. 12B and 12C provide additional views of strap 1236 and its connection to the backpack itself. It should be appreciated that, although strap 1236 is shown, the views provided in FIGS. 12B and 12C could equally represent strap 1240.

FIG. 12D provides an additional view of hip straps 1250 and 1252 in a connected or attached state in which strap 1250 is buckled to strap 1252.

In at least one embodiment, the coolant circulating through the cooling backpack 1200 may be potable water, e.g., cold water or ice water. A user could therefore intake one or more portions of the coolant for hydration while wearing the backpack. As a non-limiting example, the bladder and/or reservoir in at least one embodiment comprises a hydration port that permits the user to consume the coolant. Specifically, ice may be used as the coolant so that, as the ice melts, additional potable water and cooling effect is provided.

Figure 13:
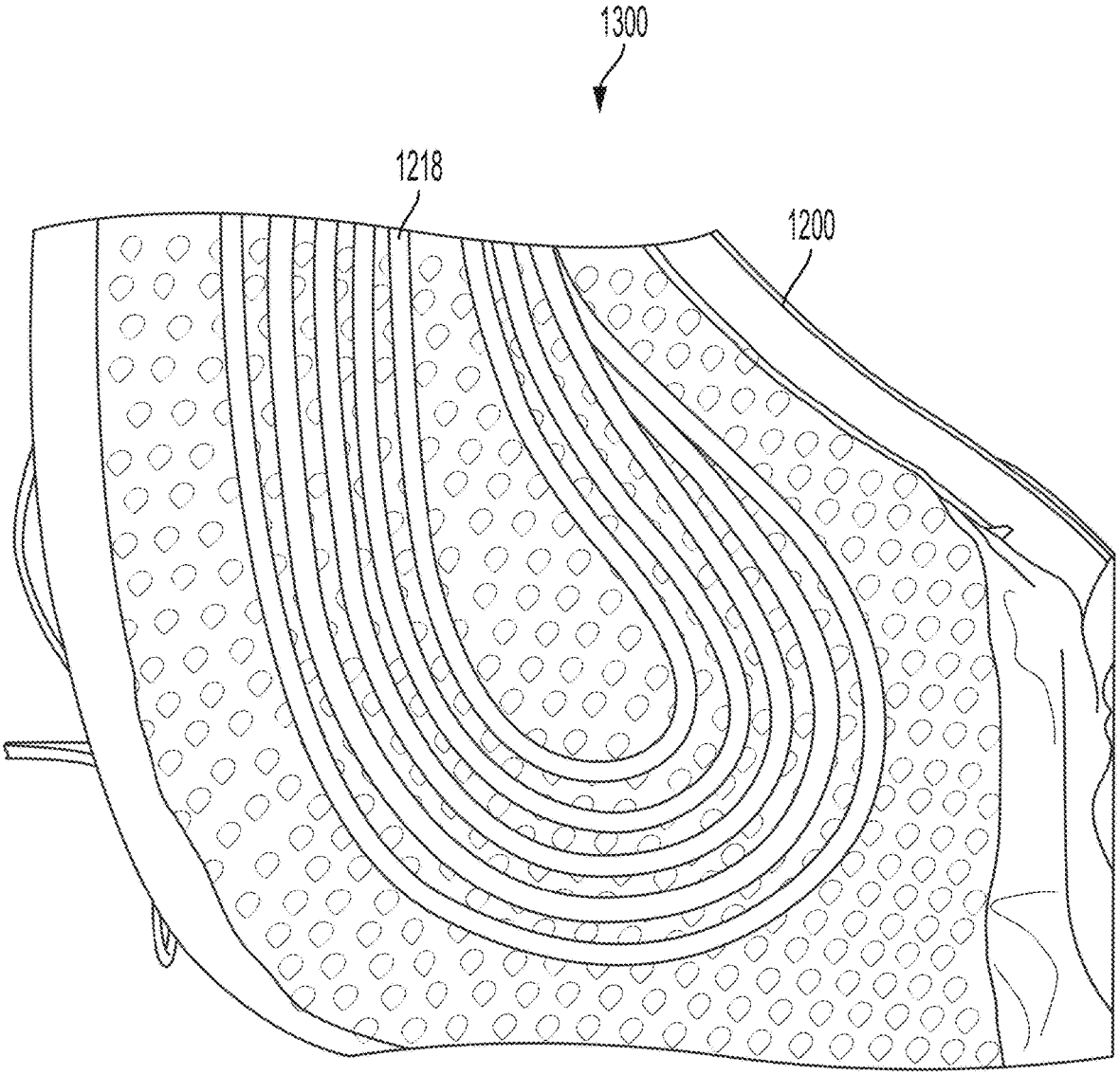
FIG. 13 is a view of a portion of the inside of a wearable cooling backpack with portions of tubing visible, according to at least one embodiment of the present disclosure.

Turning now to FIG. 13, a view of a portion 1300 of the inside of a cooling backpack with portions of the tubing visible is shown, according to at least one embodiment of the present disclosure. As a result, the cooling backpack shown may be, for instance, cooling backpack 1200. A portion of the tubing in the backpack, which may be a portion of the tubing 1218, is shown coiled and adjacent to an inner surface of the cooling backpack. In at least some portions, the tubing may be covered by one or more mesh materials.

Figure 14:
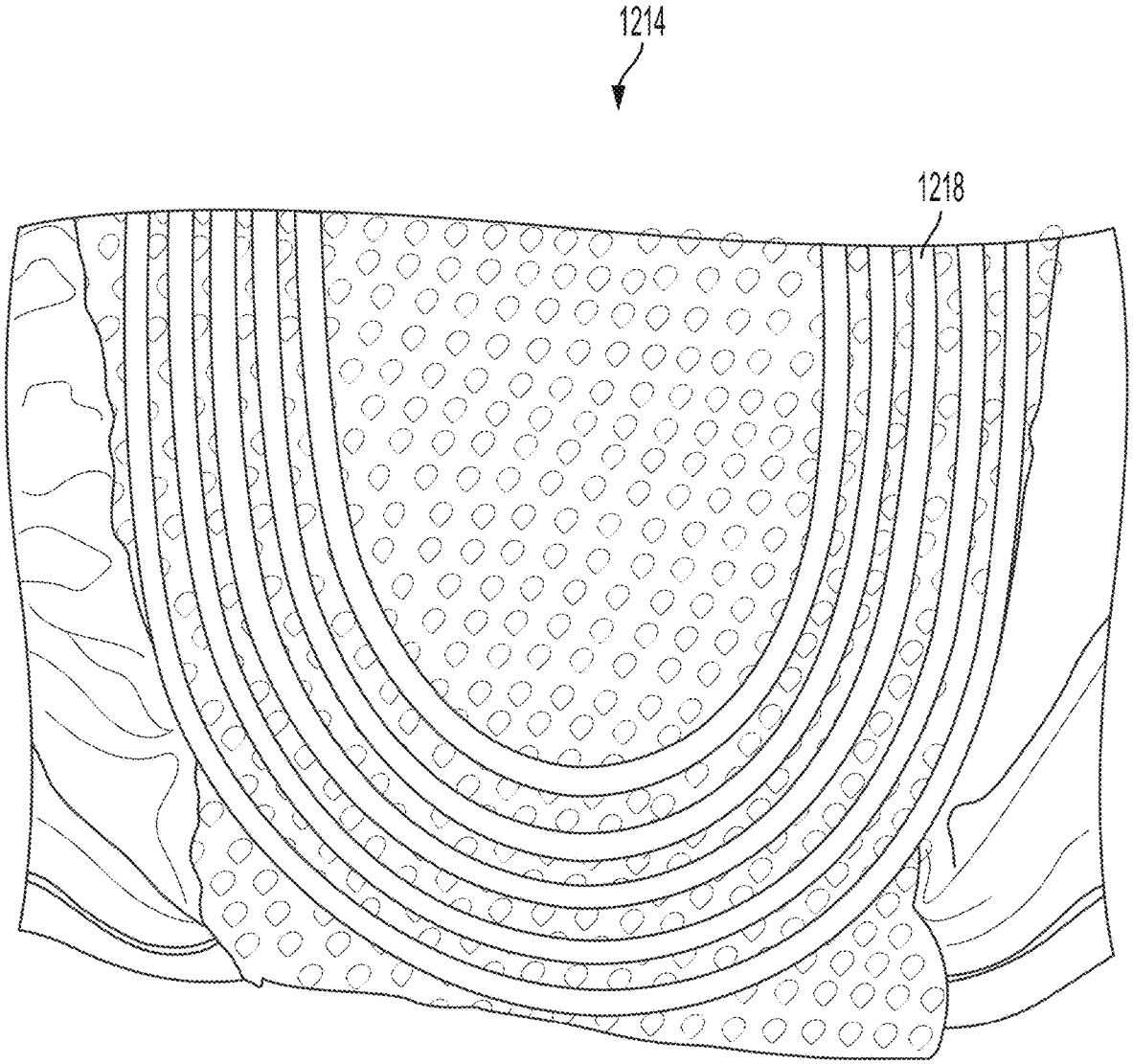
FIG. 14 is a view of a main pocket of a wearable cooling backpack, according to at least one embodiment of the present disclosure.

A further view of the main pocket of a cooling backpack, which may be, for example, main pocket 1214, is shown in FIG. 14. As stated above herein, the main pocket 1214 contains (1) a coolant reservoir such as a bladder (not shown), (2) a pump (not shown), and (3) a battery (not shown). Portions of tubing, e.g., portions of the tubing 1218, are adjacent to the main pocket and provide circulation of the coolant to and from the bladder inside the main pocket.

Figure 15:
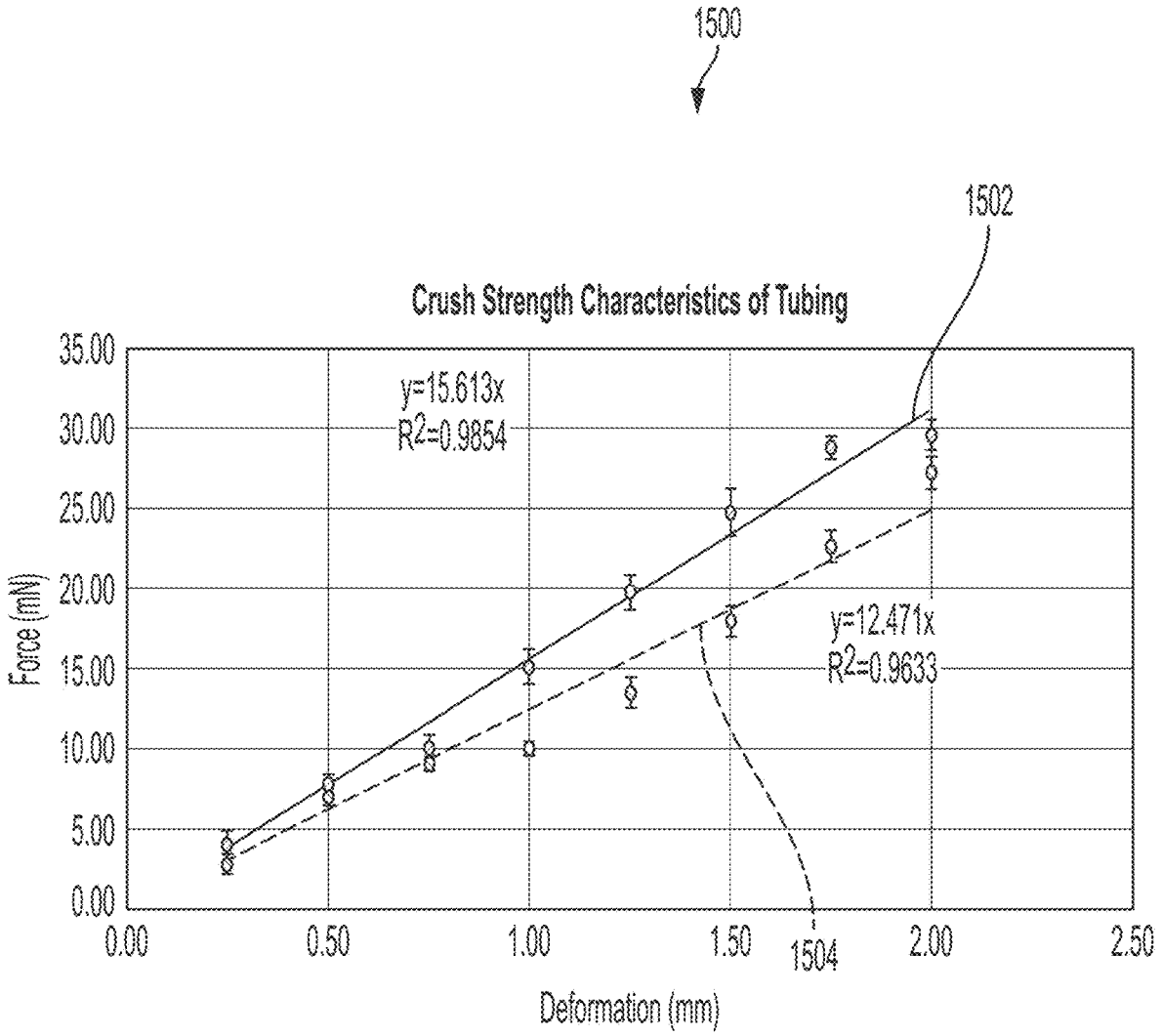
FIG. 15 is a scatter plot of the force (in mN) versus deformation distance (in mm) of tubing according to at least one embodiment of the disclosure, as compared to standard polyvinylchloride (PVC) as a control.

As mentioned above herein, strength of the tubing in the cooling backpack may be measured by the tubing's crush strength (e.g., the normal force required to pinch the tubing closed). FIG. 15 displays a scatter plot 1500 of the force (in mN) versus deformation distance (in mm) of the tubing 1502 according to an embodiment of the disclosure, as compared to standard polyvinylchloride (PVC) 1504 as a control. Specifically, a two-inch length of both the tubing and the PVC was obtained and compressed between flat platens on an Instron Universal Test System. Both samples were compressed in 0.5 mm increments and the force versus deformation was measured until complete closure or failure. As can be seen in FIG. 15, the amount of force required to crush the tubing 1502 1 mm in distance is 15.1 (±1.1) mN. By contrast, the amount of force required to crush the PVC 1504 was 10.0 (±0.4) mN. Accordingly, the crush strength of the tubing 1502 was at least 22.1% greater than PVC 1504.

Figure 16:
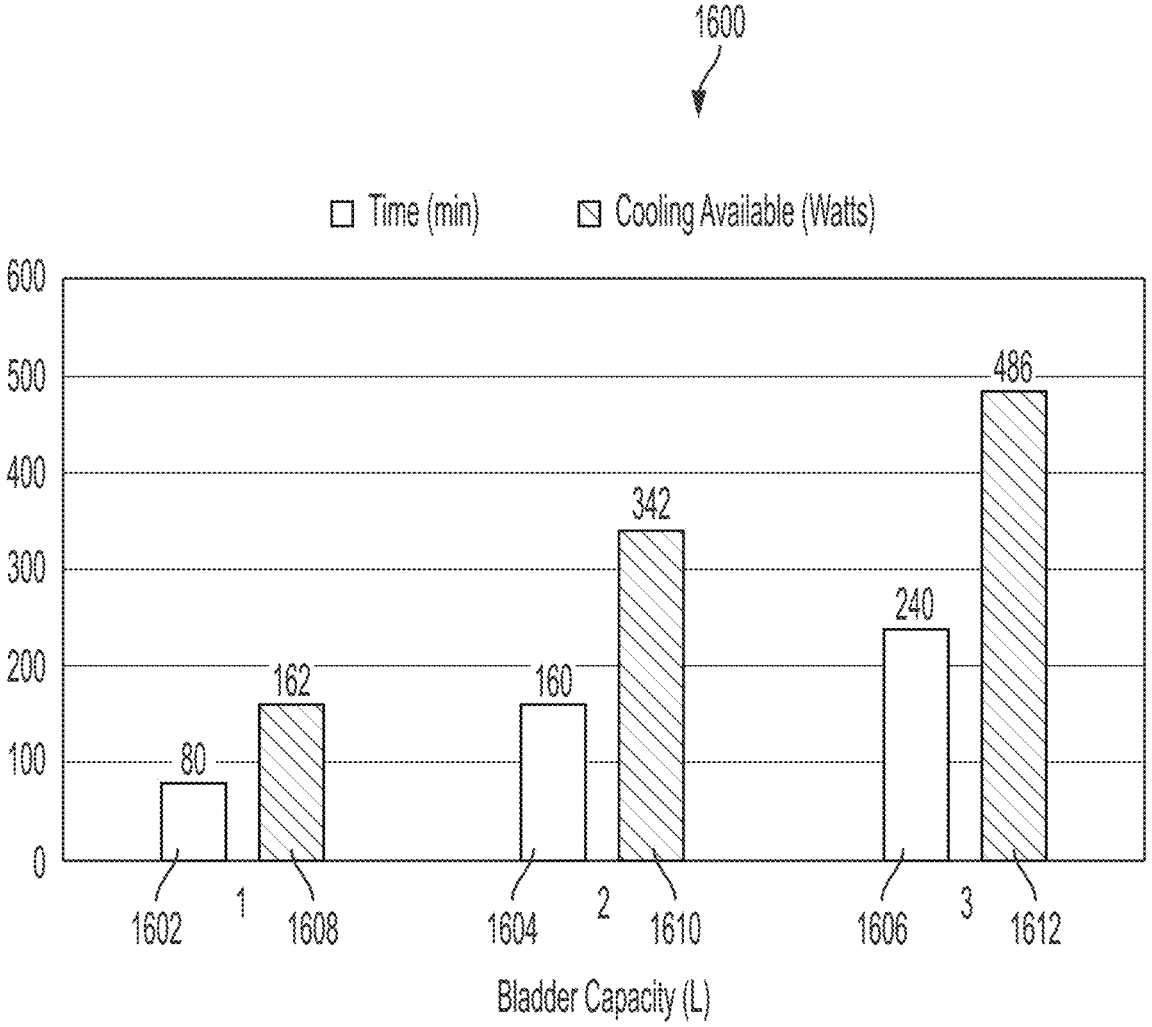
FIG. 16 is a bar graph of the relationship between bladder size (in L) and both time of cooling (in min.) and amount of cooling available (in Watts of heat extraction), according to at least one embodiment of the disclosure.

In at least some embodiments, the bladder is large enough (e.g., 1-4 L in size) to contain sufficient coolant to cool the user for several hours (e.g., up to 4 hours or more), depending on the amount of physical activity while wearing the backpack, the environmental conditions in which the backpack is being worn, the physical condition of the user, the core temperature of the user, etc. As a non-limiting example, the bladder may provide 24-26 min. of cooling per pound of coolant, and may provide up to 92 W of heat extraction per 45 min. period of activity (accounting for ambient heat loss of the coolant's cooling power). The bladder may also be insulated to prevent such ambient heat loss, thereby improving efficiency of cooling (e.g., up to 10% or more with insulation). Additional, non-limiting examples of the relationship between bladder capacity and cooling are provided in the chart 1600 shown in FIG. 16. Both time of cooling (measured in minutes) and amount of cooling available (measured in W of heat extraction) are displayed for 1 L, 2 L, and 3 L bladder capacities. As can be seen, time of cooling increases from 80 min. for a 1 L bladder (bar 1602) to 160 min. for a 2 L bladder (bar 1604) to 240 min. for a 3 L bladder (bar 1606). The amount of cooling and/or heat extraction increases from around 162 W for a 1 L bladder (bar 1608) to around 342 W for a 2 L bladder (bar 1610) to around 486 W for a 3 L bladder (bar 1612). As mentioned above, both the time of cooling and the amount of cooling available may be influenced by factors such as, e.g., the amount of physical activity (and/or the type of activity) the user is engaged in, the physical condition of the user, the ambient environment (e.g., temperature of the environment), etc.

A skilled artisan will recognize that the cooling system (e.g., the bladder with the coolant, the pump, the battery, and the tubing) in the cooling backpack is integrated into the backpack and is therefore worn by the user. Such wearable cooling devices and/or systems are easier to use than conventional wearable thermoregulatory solutions, and also offers increased comfort and performance. The tubing described herein is both flexible and non-intrusive, resulting in the ability to be positioned closer to the user's body and a concomitant greater cooling capacity. Thus, the cooling backpack is usable by individuals to stay cool while performing activities (e.g., hiking, biking, camping, etc.) in outdoor environments.

These and other objectives and features of the invention are apparent in the disclosure, which includes the above and ongoing written specification.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated.

The invention is not limited to the particular embodiments illustrated in the drawings and described above in detail.

Those skilled in the art will recognize that other arrangements could be devised. The invention encompasses every possible combination of the various features of each embodiment disclosed. One or more of the elements described herein with respect to various embodiments can be implemented in a more separated or integrated manner than explicitly described, or even removed or rendered as inoperable in certain cases, as is useful in accordance with a particular application. While the invention has been described with reference to specific illustrative embodiments, modifications and variations of the invention may be constructed without departing from the spirit and scope of the invention as set forth in the following claims.

What is claimed is:

1. A thermoregulation device comprising:

a central section;

shoulder straps connected to the central section;

a bottom section connected to the central section;

tubing that runs through the central section, the shoulder straps, and the bottom section; and a pocket comprising a coolant reservoir, a pump, and a battery, wherein the coolant reservoir comprises coolant;

wherein the tubing is fluidly connected with the coolant reservoir, wherein the battery provides power to operate the pump, and wherein the pump is operable to circulate the coolant from the coolant reservoir though the tubing.

2. The thermoregulation device of claim 1, wherein the tubing is constructed of a thermally conductive material, wherein the thermally conductive material comprises one or more base polymers and one or more additives.

3. The thermoregulation device of claim 2, wherein the thermally conductive material further comprises at least one of a secondary polymer and a plasticizer, wherein at least one of the one or more additives, the secondary polymer, and the plasticizer increases thermal conductivity of the thermally conductive material relative to thermal conductivity of the one or more base polymers.

4. The thermoregulation device of claim 1, wherein the one or more base polymers comprises at least one of ethylene vinyl acetate (EVA) and ethylene methyl acetate (EMA), and wherein the one or more additives comprises graphite fibers.

5. The thermoregulation device of claim 4, wherein the graphite fibers are at least 8% by weight of the thermally conductive material.

6. The thermoregulation device of claim 1, wherein the coolant is selected from the group consisting of: water, ice, cooling gel, and combinations thereof.

7. The thermoregulation device of claim 6, wherein the coolant is potable.

8. The thermoregulation device of claim 1, further comprising a sleeve and a hydration tube extending from the sleeve through one or more flaps disposed on the thermoregulation device, thereby enabling a user to use the hydration tube to intake fluid from a container stored in the sleeve.

9. The thermoregulation device of claim 8, wherein the sleeve is disposed on the central section.

10. The thermoregulation device of claim 9, further comprising one or more additional pockets.

11. A backpack comprising:

thermally conductive tubing in a serpentine layout and stitched into a stretch fabric;

a plurality of cartridges fluidly connected to at least one portion of the thermally conductive tubing, wherein at least one of the plurality of cartridges comprises coolant; and a device operable to circulate the coolant from the at least one of the plurality of cartridges throughout the thermally conductive tubing.

12. The backpack of claim 11, wherein the thermally conductive tubing is made from a thermally conductive material comprising one or more base polymers and between 8% and 40% by weight graphite fibers.

13. The backpack of claim 12, wherein the one or more base polymers comprises at least one polymer resin matrix.

14. The backpack of claim 13, wherein the thermally conductive tubing is made from a thermally conductive material comprising 65% to 70% by weight ethylene methyl acetate (EMA), 12% to 15% by weight graphite fibers, and 15% to 20% by weight bis(2-ethylhexyl) adipate (DEHA).

15. The backpack of claim 14, wherein the thermally conductive material further comprises 0.1% to 5% by weight ethylene propylene diene monomer (EPDM).

16. The backpack of claim 13, wherein the thermally conductive tubing is made from a thermally conductive material comprising 65% to 70% by weight ethylene vinyl acetate (EVA), 12% to 15% by weight graphite fibers, and 15% to 20% by weight bis(2-ethylhexyl) adipate (DEHA)).

17. The backpack of claim 16, wherein the thermally conductive material further comprises 0.1% to 5% by weight ethylene propylene diene monomer (EPDM).

18. A wearable article of manufacture, comprising:

one or more straps configured for a user to wear the wearable article of manufacture;

thermally conductive tubing made from a thermally conductive material comprising one or more base polymers and at least 8% by weight graphite fibers; and one or more reservoirs containing coolant, wherein the one or more reservoirs is detachable from the wearable article of manufacture and refillable with additional coolant, wherein at least one portion of the thermally conductive tubing is fluidly connected with the one or more reservoirs and runs throughout the one or more straps, and wherein the coolant is at least one of water and ice and is configured to circulate throughout the thermally conductive tubing.

19. The wearable article of manufacture of claim 18, further comprising a battery-powered pump to circulate the coolant through the wearable article of manufacture via the thermally conductive tubing.

20. A thermoregulation backpack comprising:

a plurality of shoulder straps comprising one or more sternum straps and a first set of mesh pockets;

a central section comprising a central sleeve;

a bottom section comprising a pocket, a second set of mesh pockets, and one or more hip straps; and tubing made from one or more thermally conductive materials, wherein the central section is disposed between the plurality of shoulder straps and the bottom section, wherein the plurality of shoulder straps is connected to the central section and the central section is connected to the bottom section, wherein the pocket is coverable by a flap and comprises a coolant reservoir with coolant, a pump, and a battery, wherein the tubing:

is fluidly connected to the coolant reservoir allowing the coolant to circulate through the tubing, is affixed to, and runs through, the plurality of shoulder straps, the central section, and the bottom section, wherein the battery provides power to the pump to circulate the coolant from the coolant reservoir through the tubing.

21. The thermoregulation backpack of claim 20, further comprising one or more hydration tubes running from the central sleeve through the plurality of shoulder straps.

* * * * *